US009566787B2

(12) United States Patent
Fukuzawa et al.

(10) Patent No.: US 9,566,787 B2
(45) Date of Patent: Feb. 14, 2017

(54) LIQUID EJECTING HEAD AND LIQUID EJECTING APPARATUS

(71) Applicant: SEIKO EPSON CORPORATION, Tokyo (JP)

(72) Inventors: Yuma Fukuzawa, Matsumoto (JP); Satoshi Oguchi, Okaya (JP); Hiroaki Okui, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 14/455,665

(22) Filed: Aug. 8, 2014

(65) Prior Publication Data

US 2015/0042719 A1 Feb. 12, 2015

(30) Foreign Application Priority Data

Aug. 9, 2013 (JP) ..... 2013-167008
Feb. 26, 2014 (JP) ..... 2014-035787

(51) Int. Cl.
*B41J 2/165* (2006.01)
*B41J 2/045* (2006.01)
*B41J 2/14* (2006.01)
*B41J 2/055* (2006.01)

(52) U.S. Cl.
CPC ..... *B41J 2/14233* (2013.01); *B41J 2/055* (2013.01); *B41J 2002/14419* (2013.01); *B41J 2002/14491* (2013.01)

(58) Field of Classification Search
CPC ..... B41J 2002/14491; B41J 2/1623; B41J 2002/14419; B41J 2/04585; B41J 2/14233; B41J 2/055; B41J 2/16505
USPC ..... 347/29, 44, 68, 71
See application file for complete search history.

(56) References Cited

U.S. PATENT DOCUMENTS

| | | | |
|---|---|---|---|
| 8,632,161 | B2 | 1/2014 | Kuwata et al. |
| 8,662,650 | B2 | 3/2014 | Ono et al. |
| 2006/0066690 | A1 | 3/2006 | Katayama |
| 2011/0242227 | A1 | 10/2011 | Togashi |

FOREIGN PATENT DOCUMENTS

| | | |
|---|---|---|
| JP | 2006-095725 | 4/2006 |
| JP | 2007-144734 | 6/2007 |
| JP | 2011-207190 | 10/2011 |

*Primary Examiner* — Jannelle M Lebron
(74) *Attorney, Agent, or Firm* — Workman Nydegger

(57) ABSTRACT

Provided is a liquid ejecting head that includes a manifold which communicates with a plurality of nozzle openings through which liquid is ejected, a compliance portion which constitutes a part of the manifold and is constituted by a film having flexibility, a fixing plate which is fixed to a surface side of the film, which is a side opposite to the manifold, and has an opening formed in an area which constitutes the compliance portion, and a cap member which is fixed to a surface side of the fixing plate, which is a side opposite to the compliance portion, and covers the opening, in which a protrusion portion which regulates adhering of the film to the cap member is provided, in a state where the protrusion portion is not fixed to the fixing plate, in a space formed in a portion between the compliance portion and the cap member.

10 Claims, 22 Drawing Sheets

LIQUID EJECTING HEAD AND LIQUID EJECTING APPARATUS

CROSS REFERENCES TO RELATED APPLICATIONS

This application claims priority to Japanese Patent Application No. 2013-167008 filed on Aug. 9, 2013, and Japanese Patent Application No. 2014-035787 filed on Feb. 26, 2014. The entire disclosure of Japanese Patent Application Nos. 2013-167008 and 2014-035787 are hereby incorporated herein by reference.

BACKGROUND

1. Technical Field

The present invention relates to a liquid ejecting head in which liquid is ejected through nozzle openings and a liquid ejecting apparatus, and particularly, relates to an ink jet type recording head which discharges ink as liquid and an ink jet type recording apparatus.

2. Related Art

Examples of an ink jet type recording head as a representative example of a liquid ejecting head which ejects liquid droplets include an ink jet type recording head which has nozzle openings and a flow path, such as a pressure generation chamber, communicating with the nozzle openings and in which ink droplets are discharged through the nozzle openings in such a manner that a pressure generation unit causes a pressure change of ink in the pressure generation chamber.

An ink jet type recording head having a so-called compliance portion, in which a part of a manifold communicating with a plurality of pressure generation chambers is defined by a film having flexibility, and thus pressure fluctuation of liquid in the manifold is absorbed by deforming the film, has been proposed as an example of the ink jet type recording head described above (see JP-A-2006-95725).

However, there is a possibility that the film may be bent during manufacturing processes, such as a process for adhering the film which constitutes the compliance portion and the bent film may be adhered to another member (a cap member) which forms a space between the compliance portion and the member, due to dew condensation or the like. Thus, there is a problem in that the compliance portion does not function.

Particularly, the bonding of the film is performed using an adhesive, and thus there is a possibility that viscidity of the adhesive may be recovered under a high-temperature/high-humidity condition. Therefore, there is a problem in that the film is adhered to another member (the cap member) by the adhesive.

Furthermore, even in a case where the adhesive is not applied to a part of the film, which constitutes the compliance portion, when the film is adhered to another member (the cap member) due to dew condensation or the like, an adhesion force by a surface tension increases in accordance with an area. Thus, it is not possible to separate the film in such a manner that, for example, the ink is discharged. As a result, the adhered state of the film to another member is maintained.

Such a problem is not limited to an ink jet type recording head but is also common to a liquid ejecting apparatus which ejects liquid other than ink.

SUMMARY

An advantage of some aspects of the invention is to provide a liquid ejecting head in which a compliance portion is prevented from adhering to a cap member, and thus operational failure due to adhesion of the compliance portion can be reduced and a liquid ejecting apparatus.

Aspect 1

According to an aspect of the invention, there is provided a liquid ejecting head that includes a manifold which communicates with a plurality of nozzle openings through which liquid is ejected, a compliance portion which constitutes a part of the manifold and is constituted by a film having flexibility, a fixing plate which is fixed to a surface side of the film, which is a side opposite to the manifold, and has an opening formed in an area which constitutes the compliance portion, and a cap member which is fixed to a surface side of the fixing plate, which is a side opposite to the compliance portion, and covers the opening, in which a protrusion portion which regulates adhering of the film to the cap member is provided, in a state where the protrusion portion is not fixed to the fixing plate, in a space formed in a portion between the compliance portion and the cap member.

In this case, the protrusion portion is provided, and thus the film is prevented from adhering to the cap member. Therefore, it is possible to prevent operational failure due to adhesion of the film to the cap member. Furthermore, the protrusion portion is not fixed to the fixing plate, and thus the protrusion portion can be separately provided so as not to be continuous with an opening of the fixing plate. Therefore, when a pressure in the manifold is changed to a negative pressure, the protrusion portion is prevented from regulating bending deformation of the compliance portion. As a result, the compliance portion can reliably perform absorption of a pressure in the manifold.

Aspect 2

In the liquid ejecting head according to Aspect 1, it is preferable that the protrusion portion be fixed to only one of the films and the cap member. In this case, it is possible to more effectively prevent the protrusion portion from hindering the bending deformation of the compliance portion.

Aspect 3

In the liquid ejecting head according to Aspect 2, it is preferable that the protrusion portion be fixed to the film and be not fixed to the cap member. In this case, the protrusion portion can be reliably held at a desired position, and thus it is possible to prevent a compliance function from being deteriorated due to the protrusion portion.

Aspect 4

In the liquid ejecting head according to Aspects 1 to 3, it is preferable that the protrusion portion be formed of the same material as the fixing plate. In this case, it is possible to reduce costs by reducing the number of components.

Aspect 5

In the liquid ejecting head according to Aspect 4, it is preferable that the protrusion portion be formed by performing etching on the fixing plate which is adhered to the film. In this case, it is possible to reduce the number of components and it is possible to easily form the protrusion portion with high accuracy.

Aspect 6

In the liquid ejecting head according to Aspects 1 to 5, it is preferable that a plurality of the protrusion portions be arranged in an alignment direction of the nozzle openings, and the plurality of the protrusion portions have protrusion portions of at least two types in which sizes of the protrusion portions in a direction perpendicular to the alignment direction of the nozzle openings are different in an in-plane direction of the film. In this case, it is possible to reliably prevent the film from adhering to the cap member and it is possible to prevent the protrusion portion from hindering deformation of the compliance portion as much as possible.

Aspect 7

In the liquid ejecting head according to Aspects 1 to 6, it is preferable that a plurality of the manifolds be provided, and each space which is formed in a portion between the compliance portion corresponding to each manifold and the cap member be separately opened to the atmosphere. In this case, the space formed in a portion between each compliance portion and the cap member is opened to the atmosphere, and thus the compliance portion can be deformed in a bent manner.

Aspect 8

In the liquid ejecting head according to Aspects 1 to 7, it is preferable that a plurality of the manifolds be provided, and the space which is formed in a portion between the compliance portion corresponding to the manifold and the cap member have a first space which is opened to the atmosphere and a second space which communicates with the first space and is opened to the atmosphere through the first space. In this case, it is not necessary to separately form an atmosphere releasing path, and thus a space for forming a plurality of atmosphere releasing paths is not necessary. As a result, it is possible to reduce the size of the head.

Aspect 9

According to another aspect of the invention, there is provided a liquid ejecting apparatus including the liquid ejecting head according to Aspects 1 to 8.

In this case, it is possible to realize a liquid ejecting apparatus in which the compliance portion is prevented from adhering to the cap member, and thus operational failure due to adhesion of the compliance portion is reduced.

Aspect 10

According to still another aspect of the invention, there is provided a liquid ejecting head that includes a manifold which communicates with a plurality of nozzle openings through which liquid is ejected, a compliance portion which constitutes a part of the manifold and is constituted by a film having flexibility, and a cap member is provided on a surface side of the compliance portion, which is a side opposite to the manifold, so as to cover the compliance portion in a state where a space is provided between the cap member and the compliance portion, in which one compliance portion is provided for each manifold, and a protrusion portion which regulates adhering of the film to the cap member is provided in a space formed in a portion between the compliance portion and the cap member, so as not to partition the space.

In this case, even when a part of the film, which constitutes the compliance portion, is bent, the protrusion portion prevents the compliance portion from adhering to the cap member. As a result, the compliance portion functions as it is intended to function.

Aspect 11

In the liquid ejecting head according to Aspect 10, it is preferable that a plurality of the protrusion portions be arranged in an alignment direction of the nozzle openings, and the plurality of the protrusion portions be provided, in an in-plane direction of the film, at intervals equal to or greater than a width of the compliance portion in a direction perpendicular to the alignment direction of the nozzle openings. In this case, it is possible to prevent a compliance amount (capacity of absorption pressure-fluctuation of the manifold) of the entirety of the compliance portion from being significantly reduced.

Aspect 12

In the liquid ejecting head according to Aspects 10 and 11, it is preferable that an individual flow path be provided in a portion between the manifold and the nozzle opening, and the protrusion portion protrude from a side, which is opposite to an area in which the individual flow path communicates with the manifold, to the space, in a state where the protrusion portion does not reach a side in which the individual flow path communicates with the manifold. In this case, the protrusion portion is not provided on the side in which the individual flow path communicates with the manifold. Therefore, the compliance portion in an area adjacent to each individual flow path functions, and thus the compliance portion can absorb the pressure fluctuation in each individual flow path. In other words, it is possible to uniformize a compliance amount of each compliance portion corresponding to each flow path. Thus, it is possible to uniformize discharging properties of liquid droplets.

Aspect 13

In the liquid ejecting head according to Aspects 10 to 12, it is preferable that the protrusion portion have a shape in which a base end portion of a protrusion is thicker than a tip portion thereof. In this case, it is possible to increase hardness of the protrusion portion.

Aspect 14

The liquid ejecting head according to Aspects 10 to 13 may further include a fixing plate which is fixed to a surface side of the film, which is a side opposite to the manifold, and has an opening formed in an area which constitutes the compliance portion, and it is preferable that the protrusion portion be integrally formed in the fixing plate. In this case, it is possible to provide the protrusion portion without adding other members, and thus it is possible to reduce costs.

Aspect 15

In the liquid ejecting head according to Aspects 10 to 14, it is preferable that the protrusion portion be integrally formed in the cap member. In this case, it is possible to provide the protrusion portion without adding other members, and thus it is possible to reduce costs.

Aspect 16

In the liquid ejecting head according to Aspects 1 to 15, it is preferable that a plurality of the manifolds be provided, and each space which is formed in a portion between the compliance portion corresponding to each manifold and the cap member be separately opened to the atmosphere. In this case, the space formed in a portion between each compliance portion and the cap member is opened to the atmosphere, and thus the compliance portion can be deformed in a bent manner.

Aspect 17

In the liquid ejecting head according to Aspects 10 to 15, it is preferable that a plurality of the manifolds be provided, and each space which is formed in a portion between the compliance portion corresponding to the manifold and the cap member have a first space which is opened to the atmosphere and a second space which communicates with the first space and is opened to the atmosphere through the first space. In this case, it is not necessary to separately form an atmosphere releasing path, and thus a space for forming a plurality of atmosphere releasing paths is not necessary. As a result, it is possible to reduce the size of the head.

Aspect 18

According to still another aspect of the invention, there is provided a liquid ejecting apparatus including the liquid ejecting head according to Aspects 10 to 17.

In this case, it is possible to realize a liquid ejecting apparatus in which the compliance portion is prevented from adhering to the cap member, and thus operational failure due to adhesion of the compliance portion is reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the detail of embodiments of the invention will be described.

Embodiment 1

Figure 1:
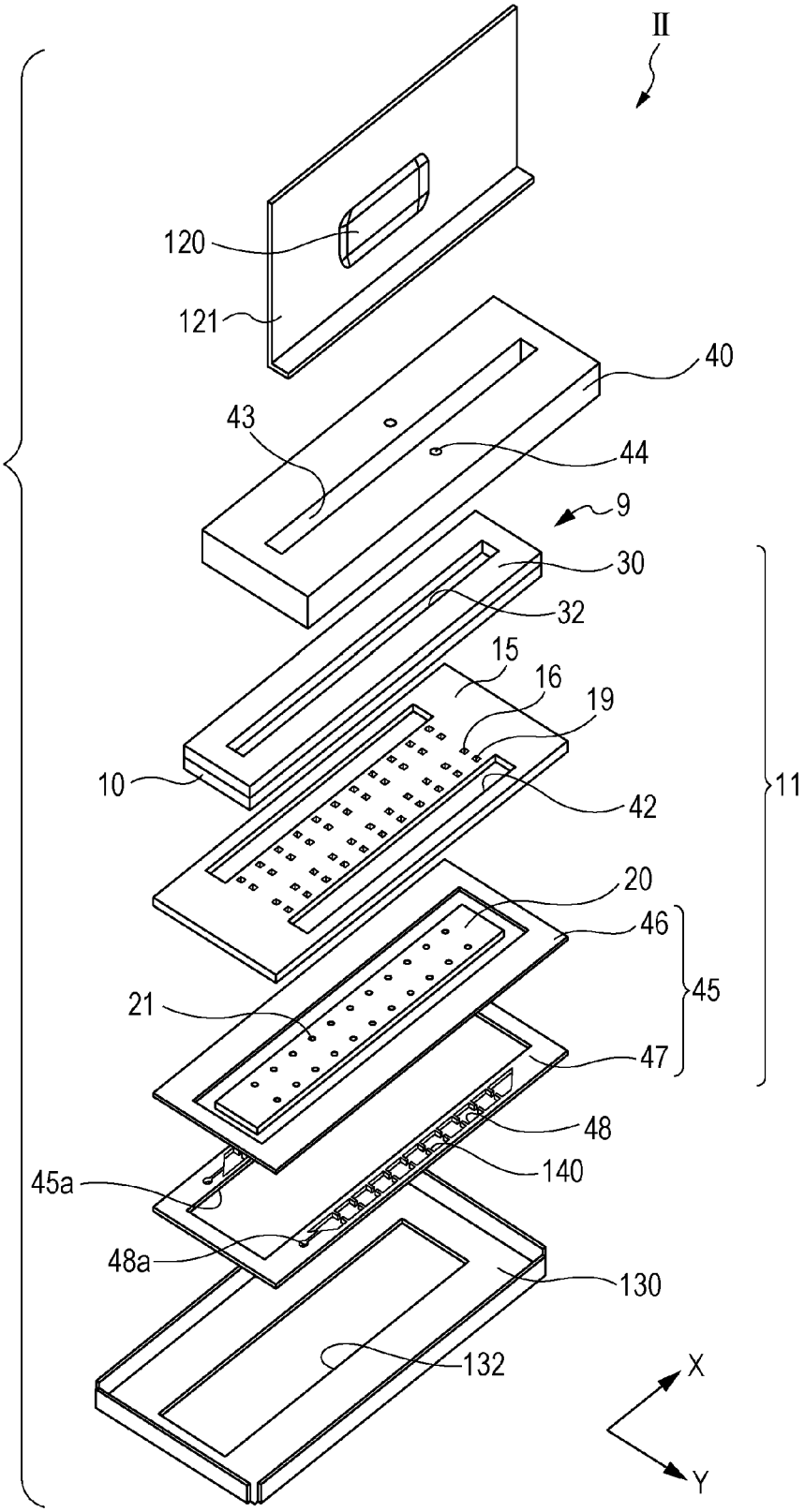
FIG. 1 is an exploded perspective view of a recording head according to Embodiment 1.
Figure 2:
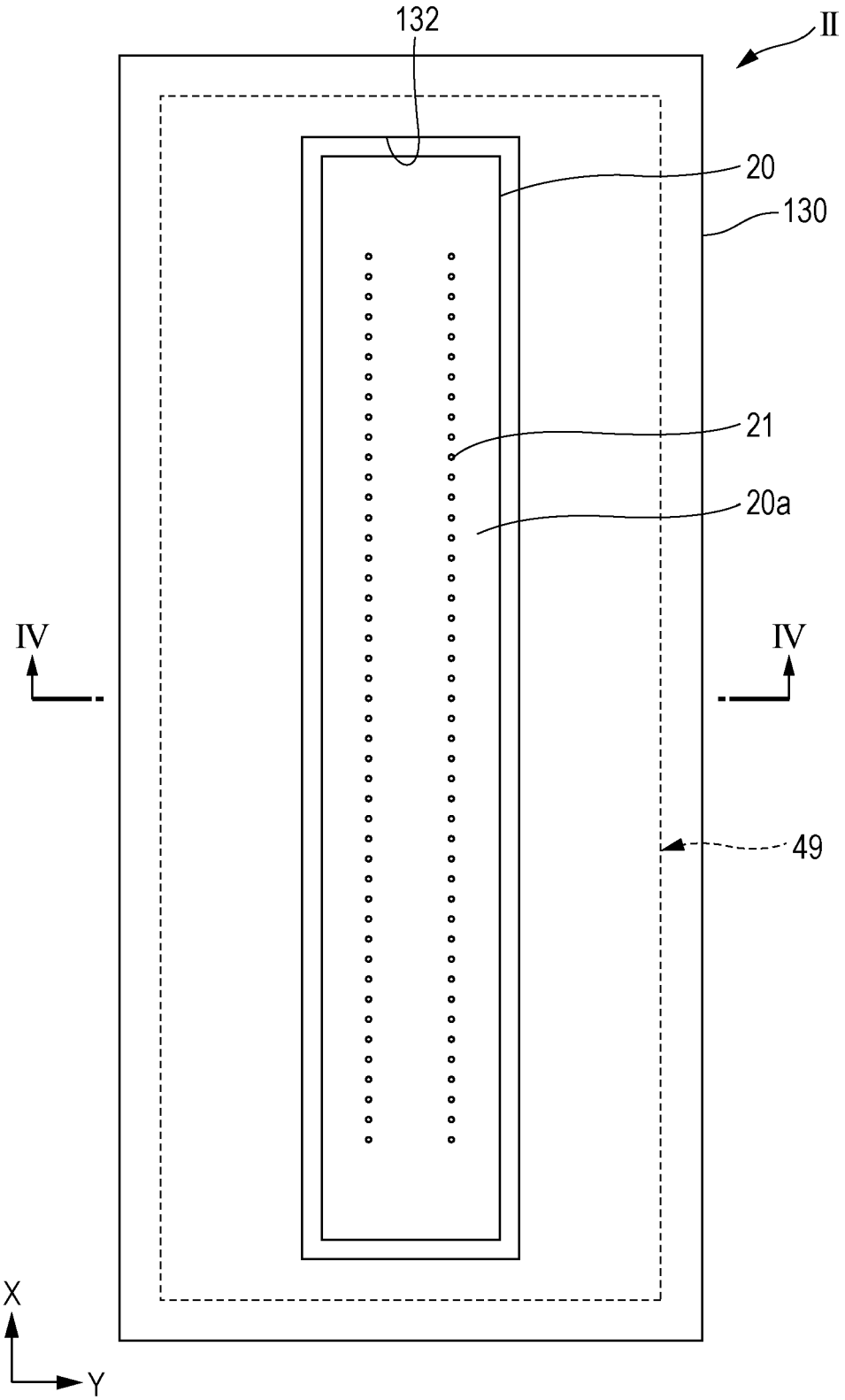
FIG. 2 is a plan view of the recording head according to Embodiment 1.
Figure 3:
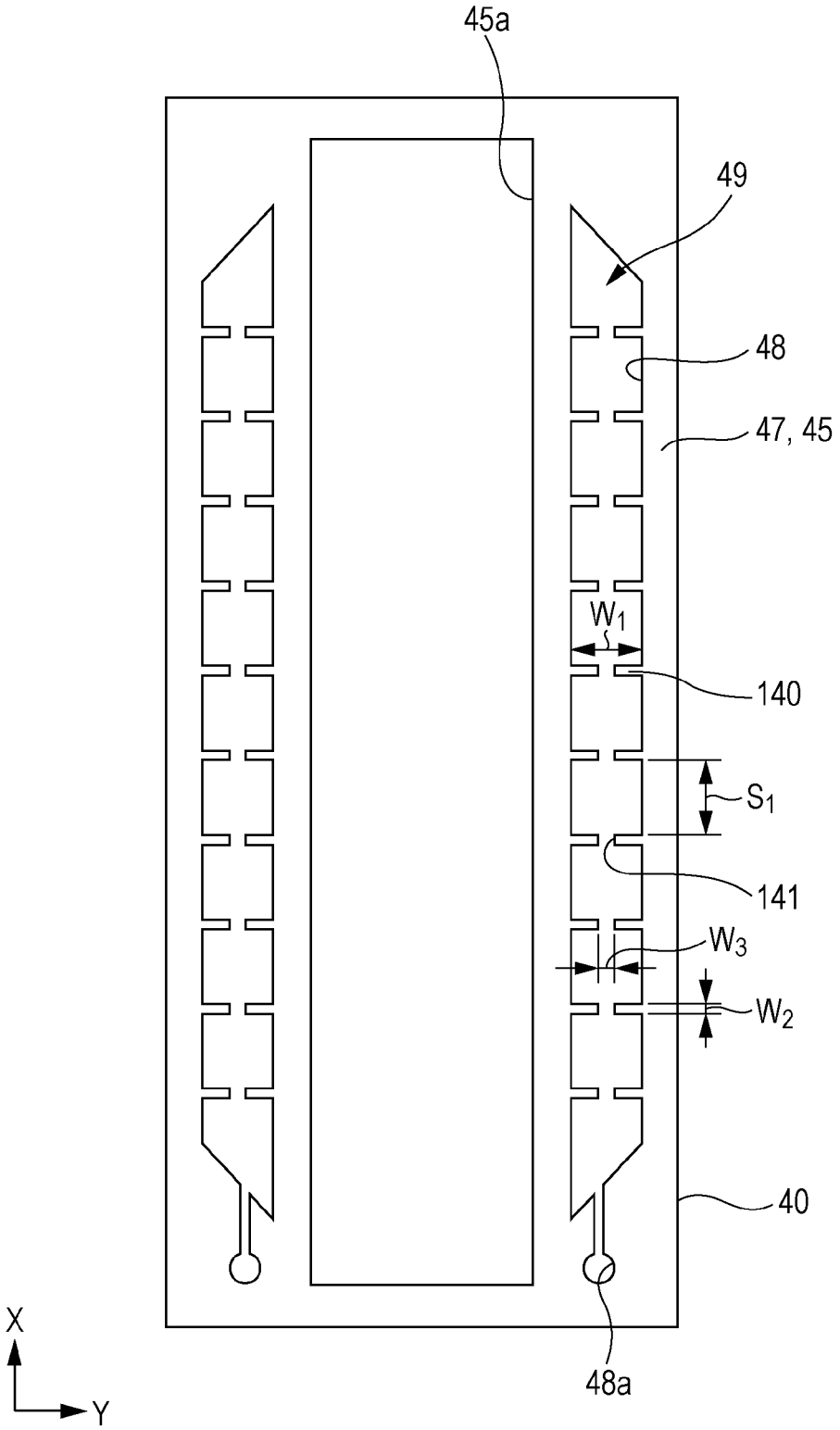
FIG. 3 is a plan view of a compliance substrate according to Embodiment 1.
Figure 4:
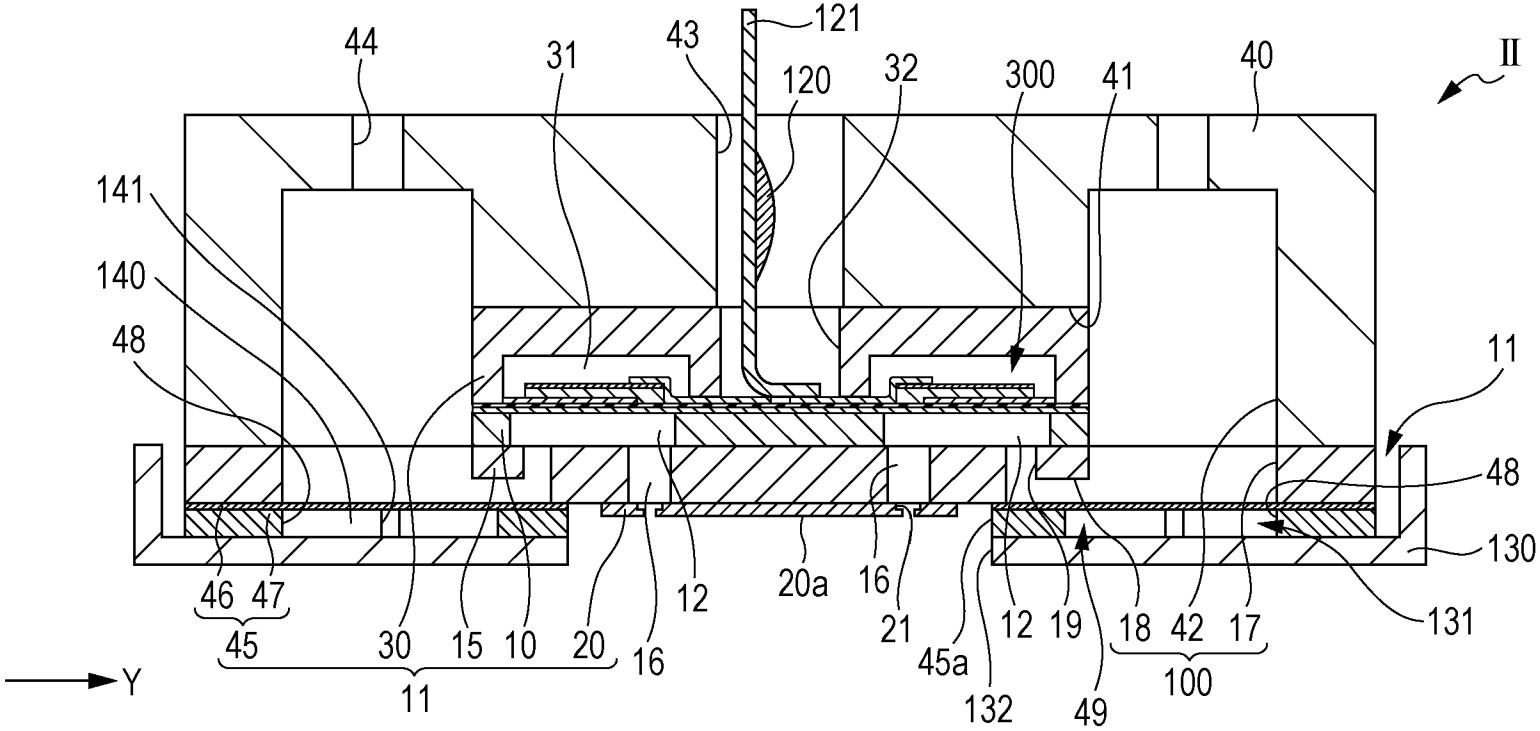
FIG. 4 is a cross-sectional view of the recording head according to Embodiment 1.
Figure 5:
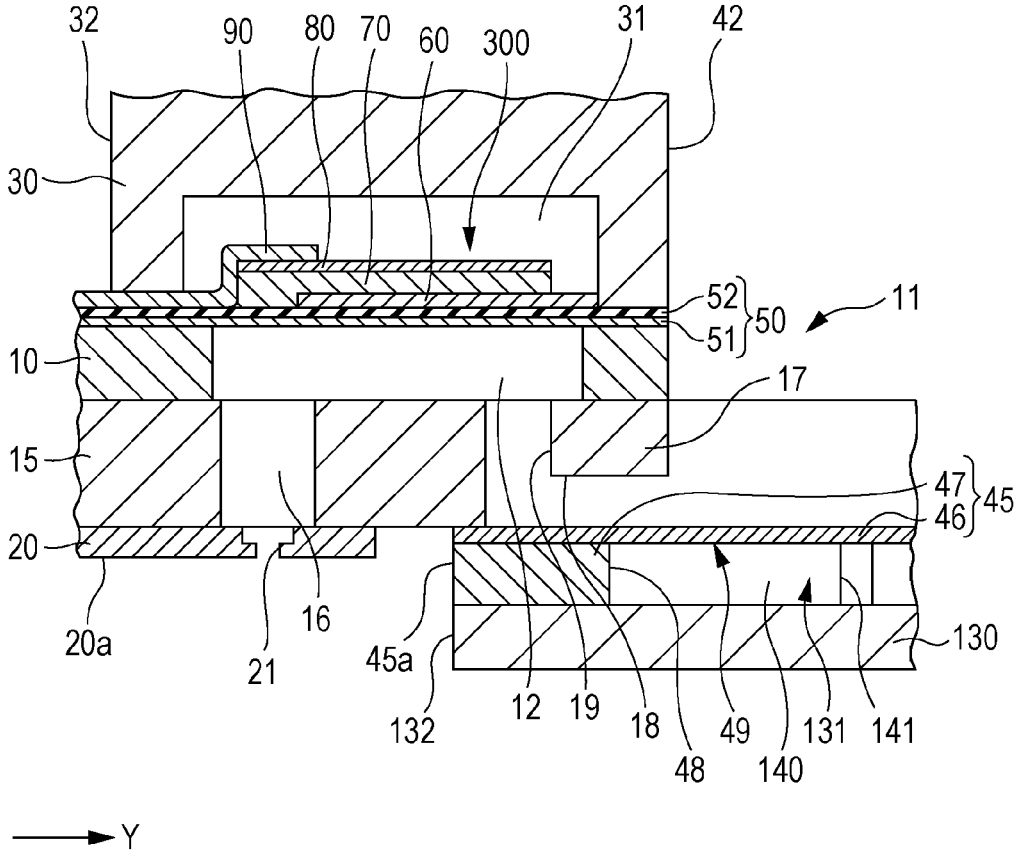
FIG. 5 is an enlarged cross-sectional view of a principal portion of the recording head according to Embodiment 1.

FIG. 1 is an exploded perspective view of an ink jet type recording head as an example of a liquid ejecting head according to Embodiment 1 of the invention. FIG. 2 is a plan view of the ink jet type recording head. FIG. 3 is a plan view of a compliance substrate and FIG. 4 is a cross-sectional view taken along line IIII-IIII in FIG. 2. FIG. 5 is an enlarged cross-sectional view of a principal portion of FIG. 4.

An ink jet type recording head II (hereinafter, simply referred to as a recording head II) of Embodiment 1 includes a plurality of members, such as a head main body 11, a case member 40 which is fixed to one surface side of the head main body 11, and a cover head 130 which is fixed to the other surface side of the head main body 11, as illustrated in the accompanying drawings. The head main body 11 of Embodiment 1 includes a flow-path forming substrate 10, a communication plate 15 which is provided on one surface side of the flow-path forming substrate 10, a nozzle plate 20 which is provided on a surface side of the communication plate 15, which is a side opposite to the flow-path forming substrate 10, a protection substrate 30 which is provided on a surface side of the flow-path forming substrate 10, which is a side opposite to the communication plate 15, and a compliance substrate 45 which is provided on a surface side of the communication plate 15, on which the nozzle plate 20 is provided.

Examples of materials forming the flow-path forming substrate 10 which constitutes the head main body 11 include metal, such as stainless steel and Ni, a ceramic material represented by $ZrO_2$ or $Al_2O_3$, a glass-ceramic material, and oxide, such as MgO, $LaAlO_3$. In Embodiment 1, the flow-path forming substrate 10 is formed of a silicon single crystal substrate. A plurality of pressure generation chambers 12 which are partitioned by a partitioning wall are formed on the flow-path forming substrate 10 in such a manner that the flow-path forming substrate 10 is subjected to anisotropic etching from one surface side. The plurality of pressure generation chambers 12 are aligned along a direction in which a plurality of nozzle openings 21 through which ink is discharged are aligned. Hereinafter, this direction will be referred to as an alignment direction of the pressure generation chambers 12 or a first direction X. A plurality, that is, two in Embodiment 1, of rows in which the plurality of pressure generation chambers 12 are aligned in the first direction X are provided on the flow-path forming substrate 10. Hereinafter, a direction in which the plurality of rows in which the plurality of pressure generation chambers 12 are aligned in the first direction X will be referred to as a second direction Y.

In the flow-path forming substrate 10, for example, a supply path of which an opening size is narrower than the pressure generation chamber 12 and which applies flow-path resistance to the ink flowing into the pressure generation chamber 12 may be provided on one end portion side of the pressure generation chamber 12 in the second direction Y.

In addition, the communication plate 15 and the nozzle plate 20 are laminated, in order, on one surface side of the flow-path forming substrate 10. In other words, the communication plate 15 which is provided on one surface side of the flow-path forming substrate 10 and the nozzle plate 20 which is provided on a surface side of the communication plate 15, which is a side opposite to the flow-path forming substrate 10, and has nozzle openings 21 formed thereon are provided.

A nozzle communication path 16 allows the pressure generation chambers 12 to communicate with the nozzle openings 21 is provided in the communication plate 15. A size of the communication plate 15 is greater than the flow-path forming substrate 10 and the size of the nozzle plate 20 is smaller than the flow-path forming substrate 10. The communication plate 15 is provided as described above, and thus the nozzle openings 21 of the nozzle plate 20 is separated from the pressure generation chambers 12. Therefore, it is difficult for the ink in the pressure generation chamber 12 to be thickened, resulting from evaporation of moisture in ink, which is caused in the ink in the vicinity of the nozzle opening 21. Furthermore, the nozzle plate 20 may be of any size as long as it can cover an opening of the nozzle communication path 16 which allows the pressure generation chambers 12 to communicate with the nozzle openings 21, and thus the size of the nozzle plate 20 can be set to be comparatively small. In addition, the size of the flow-path forming substrate 10 can be set to be smaller than the communication plate 15, and thus it is possible to reduce costs. In Embodiment 1, a surface of the nozzle plate 20, on which the nozzle openings 21 are opened and through which ink droplets are discharged, is referred to as a liquid ejection surface 20*a*.

A first manifold portion 17 and a second manifold portion 18 which constitute a part of a manifold 100 are provided in the communication plate 15.

The first manifold portion 17 is provided to pass through the communication plate 15 in a thickness direction (a laminating direction of the communication plate 15 and the flow-path forming substrate 10).

The second manifold portion 18 is formed in the communication plate 15 so as to be opened to the nozzle plate 20 side, without passing through the communication plate 15 in the thickness direction.

Supply communication paths 19 which communicate with one end portions of the pressure generation chambers 12 in the second direction Y are provided on the communication plate 15 such that the respective supply communication paths 19 are individually provided for each pressure generation chamber 12. The supply communication path 19 allows the second manifold portion 18 to communicate with the pressure generation chambers 12. In other words, in Embodiment 1, the supply communication path 19, the pressure generation chamber 12, and the nozzle communication path 16 are provided as an individual flow path which allows the nozzle opening 21 to communicate with the second manifold portion 18.

Examples of materials forming the communication plate 15 include metal, such as stainless steel and nickel (Ni), and ceramics, such as zirconium (Zr). It is preferable that the communication plate 15 be formed of a material of which a linear expansion coefficient is the same as the flow-path forming substrate 10. In other words, in a case where the communication plate 15 is formed of a material of which a linear expansion coefficient is significantly different from the flow-path forming substrate 10, when the flow-path forming substrate 10 and the communication plate 15 are subjected to heating or cooling, bending can be caused due to a difference in linear expansion coefficients of the flow-path forming substrate 10 and the communication plate 15. In Embodiment 1, the communication plate 15 is constituted by the same material as the material forming the flow-path forming substrate 10, that is, a silicon single crystal substrate. Therefore, it is possible to prevent, for example, bending due to heating, a crack due to heating, and separation from occurring.

The nozzle openings 21 which respectively communicate with the pressure generation chambers 12 via the nozzle communication paths 16 are formed on the nozzle plate 20. In other words, parts of the nozzle openings 21, through which the same kind of liquid (ink) is ejected, are aligned in the first direction X. Two rows in which the nozzle openings 21 are aligned in the first direction X are formed in the second direction Y.

Examples of materials forming the nozzle plate 20 include metal, such as stainless steel (SUS), organic matter, such as a polyimide resin, and a silicon single crystal substrate. The nozzle plate 20 is constituted by a silicon single crystal substrate, and thus the nozzle plate 20 and the communication plate 15 have the same linear expansion coefficient. Therefore, it is possible to prevent, for example, bending due to heating or cooling, a crack due to heating, and separation from occurring.

Meanwhile, a diaphragm 50 is formed on a surface side of the flow-path forming substrate 10, which is a side opposite to the communication plate 15. In Embodiment 1, an elastic film 51 which is provided on the flow-path forming substrate 10 side and formed of oxide silicon and an insulator film 52 which is provided on the elastic film 51 and formed of zirconium oxide are provided as the diaphragm 50. Liquid flow paths such as the pressure generation chambers 12 are formed in such a manner that the flow-path forming substrate 10 is subjected to anisotropic etching from one surface side (a surface side to which the nozzle plate 20 is adhered). The other surfaces of the liquid flow paths, such as the pressure generation chambers 12, are formed by the elastic film 51.

A first electrode 60, a piezoelectric layer 70, and a second electrode 80 which are laminated on the insulator film 52 of the diaphragm 50 constitute a piezoelectric actuator 300. In this case, the piezoelectric actuator 300 refers to a portion which includes the first electrode 60, the piezoelectric layer 70, and the second electrode 80. Generally, any one of the electrodes of the piezoelectric actuator 300 is set to be a common electrode, and the other electrode and the piezoelectric layer 70 are provided for each pressure generation chamber 12, in a patterned manner. In this case, a portion which is constituted by any one of the electrodes and the piezoelectric layer 70, both of which are patterned, and in which piezoelectric strain occurs due to application of voltage to both electrodes is referred to as a piezoelectric active portion. In Embodiment 1, the first electrode 60 is set to a common electrode of the piezoelectric actuator 300 and the second electrode 80 is set to an individual electrode of the piezoelectric actuator 300. However, even when the common electrode and the individual electrode are switched for the convenience of a driving circuit or wiring, there are no problems. In addition, in an example described above, the first electrode 60 continuously extends over the plurality of pressure generation chambers 12, and thus the first electrode 60 functions as a part of a diaphragm. However, needless to say, the configuration is not limited thereto and only the first electrode 60 may function as a diaphragm, without providing, for example, the elastic film 51 and the insulator film 52 described above. Practically, the piezoelectric actuator 300 itself may also function as a diaphragm. However, in a case where the first electrode 60 is provided directly above the flow-path forming substrate 10, it is preferable that the first electrode 60 is protected by, for example, a protective film having insulation properties such that the first electrode 60 and the ink are not electrically conducted. In other words, although a configuration in which the first electrode 60 is provided on a substrate (the flow-path forming substrate 10) via the diaphragm 50 is exemplified in Embodiment 1, the configuration is not particularly limited thereto. The first electrode 60 may be provided directly on the substrate, without providing the diaphragm 50. That is, the first electrode 60 may also function as a diaphragm. In other words, a meaning of "above a substrate" includes "directly above a substrate" and "above (over) a substrate with a member interposed therebetween".

A lead electrode 90 which is formed of, for example, gold (Au) and is drawn from the vicinity of an end portion on a side opposite to the supply communication path 19 and which extends to an upper portion of the diaphragm 50 is connected to each second electrode 80 as an individual electrode of the piezoelectric actuator 300 described above.

The protection substrate 30 of which the size is approximately the same as the flow-path forming substrate 10 is adhered to a surface side of the flow-path forming substrate 10, which is a side facing the piezoelectric actuator 300 as a pressure generation unit. The protection substrate 30 has a holding portion 31 which is a space for protecting the piezoelectric actuator 300.

The case member 40 is fixed to the head main body 11 configured as above. The case member 40 and the head main body 11 form the manifold 100 which communicates with the plurality of pressure generation chambers 12. When seen in a plan view, the case member 40 has substantially the same shape as the communication plate 15 described above. The case member 40 is adhered to both the protection substrate 30 and the communication plate 15 described above. Specifically, a concave portion 41 is formed on the protection substrate 30 side of the case member 40. A depth of the concave portion 41 is deep enough to accommodate the flow-path forming substrate 10 and the protection substrate 30. An opening size of the concave portion 41 is greater than a surface of the protection substrate 30, which is a surface adhered to the flow-path forming substrate 10. In a state where the flow-path forming substrate 10 and the like are accommodated in the concave portion 41, an opening surface of the concave portion 41, which faces the nozzle plate 20 side, is sealed by the communication plate 15. Therefore, a third manifold portion 42 is formed, on an outer peripheral portion of the flow-path forming substrate 10, by the case member 40 and the head main body 11. The manifold 100 of Embodiment 1 is constituted by the first manifold portion 17, the second manifold portion 18, which are formed in the communication plate 15, and the third manifold portion 42 which is formed by the case member 40 and the head main body 11. In other words, the manifold 100 includes the first manifold portion 17, the second manifold portion 18, and the third manifold portion 42. The manifolds 100 of Embodiment 1 are disposed, in the second direction Y, on both outer sides of two rows of the pressure generation chambers 12. Two manifolds 100 which are disposed on both outer sides of two rows of the pressure generation chambers 12 are separately provided such that the two manifolds 100 do not communicate in the recording head II. In other words, one manifold 100 is provided for each row (a row aligned in the first direction X) of the pressure generation chambers 12 of Embodiment 1, in a state where the one manifold 100 communicates with the pressure generation chambers 12.

Introduction paths 44 are provided in the case member 40. The introduction paths 44 communicate with the manifolds 100 and respectively supply the ink to the manifolds 100. A connection port 43 is provided in the case member 40. The connection port 43 communicates with an insertion hole 32 of the protection substrate 30 and has a wiring substrate 121 inserted therethrough.

Two manifolds 100 may communicate on an upstream side of the recording head II, that is, in an upstream flow path which is connected to the introduction path 44 communicating with the manifold 100. The upstream flow path will be described in detail.

Examples of materials forming the case member 40 include, for example, a resin and metal. Incidentally, the case member 40 can be mass-produced at a low cost, by molding a resin material.

A compliance substrate 45 is provided on a surface of the communication plate 15, on which the first manifold portion 17 and the second manifold portion 18 are opened, as illustrated in FIGS. 3 to 5. When seen in a plan view, a size of the compliance substrate 45 is substantially the same as the communication plate 15 described above. A first exposure opening portion 45*a* through which the nozzle plate 20 is exposed is provided on the compliance substrate 45. In a state where the nozzle plate 20 is exposed through the first exposure opening portion 45*a*, the compliance substrate 45 seals openings of the first manifold portion 17 and the second manifold portion 18, which face the liquid ejection surface 20*a* side.

In other words, the compliance substrate 45 forms a part of the manifold 100. The compliance substrate 45 includes a sealing film 46 which is a film and a fixing substrate 47 which is a fixing plate. The sealing film 46 is constituted by a thin film (for example, a thin film which is formed of polyphenylene sulfide (PPS), aromatic polyamide (aramid), or the like and of which a thickness is equal to or less than 20 μm) having flexibility. The fixing substrate 47 is formed of a hard material, for example, metal such as stainless steel (SUS). A part of the fixing substrate 47, which is opposite to the manifold 100, is an opening portion 48 in which a part of the fixing substrate 47 is completely removed in the thickness direction. Thus, this portion forms a compliance portion 49 which is a flexible portion, in which one surface of the manifold 100 is sealed by only the sealing film 46 having flexibility. In Embodiment 1, one compliance portion 49 is provided to one manifold 100. In other words, in Embodiment 1, two manifolds 100 are provided, and thus two compliance portions 49 are provided on both sides in the second direction Y, with the nozzle plate 20 interposed between both sides.

The cover head 130 which is a cap member of Embodiment 1 is provided on a liquid ejection surface 20*a* side of the head main body 11.

A second exposure opening portion 132 through which the nozzle openings 21 are exposed is provided on the cover head 130. In Embodiment 1, the second exposure opening portion 132 is of a size allowing the nozzle plate 20 to be exposed. That is, the size of the second exposure opening portion 132 is substantially the same as the first exposure opening portion 45*a* of the compliance substrate 45.

In addition, in Embodiment 1, end portions of the cover head 130 are formed to be bent from the liquid ejection surface 20*a* side, such that the end portions cover side surfaces (surfaces perpendicular to the liquid ejection surface 20*a*) of the head main body 11.

The cover head 130 is adhered to a surface side of the compliance substrate 45, which is a side opposite to the communication plate 15. The cover head 130 seals a space of the compliance portion 49, which is located on a side opposite to a flow path (the manifold 100). In other words, the cover head 130 as a cap member is provided to cover the compliance portion 49 in a state where a space 131 is positioned in a portion between the compliance portion 49 and the cover head 130. The compliance portion 49 is covered by the cover head 130 as a cap member, as described above, and thus it is possible to prevent the compliance portion 49 from being damaged even when a recording medium, such as a paper sheet, comes into contact with the compliance portion 49. Furthermore, it is possible to prevent the ink (liquid) from adhering to the compliance portion 49 and it is possible to wipe away, using a wiper blade or the like, the ink (the liquid) adhering to a surface of the cover head 130. Thus, it is possible to prevent a recording medium from being stained with, for example, ink adhering to the cover head 130.

The space 131 which is formed in a portion between the compliance portion 49 and the cover head 130 is opened outside the recording head II so as to be opened to the atmosphere. In Embodiment 1, an through hole 48*a* which passes through the fixing substrate 47 in the thickness direction is provided on one side of each compliance portion 49 in the first direction X. The through hole 48*a* communicates with the opening portion 48, and thus the space 131 which is formed in a portion between the compliance portion 49 and the cover head 130 is opened, through the through hole 48*a*, outside the recording head II so as to be opened to the atmosphere. The through hole 48*a* which communicates with the space 131 formed in a portion between the compliance portion 49 and the cover head 130 may be opened to, for example, the liquid ejection surface 20*a* side of the recording head II, a lateral side, or a side (the case member 40 side) opposite to the liquid ejection surface 20*a*, so as to be opened to the atmosphere. However, there is a possibility that failure, for example, clogging of a path opened to the atmosphere or adhering of ink to the compliance portion 49, both of which are caused by ink flowing into through an opening opened to the atmosphere, may occur. Thus, it is preferable that the path opened to the atmosphere, which communicates with the through hole 48*a* and is not illustrated, be opened to a surface side opposite to the liquid ejection surface 20*a*, that is, opened outside to the case member 40 side, so as to be opened to the atmosphere. In addition, the through hole 48*a* may be opened to the atmosphere, as follows. A path opened to the atmosphere (not illustrated), such as a groove or an insertion hole, is provided in a member (the flow-path forming substrate 10, the communication plate 15, or the like) which constitutes the recording head II, and the through hole 48*a* may communicate with the outside through the path opened to the atmosphere. In Embodiment 1, the through hole 48*a* is provided for each compliance portion 49 and a path opened to the atmosphere (not illustrated) is provided for each through hole 48*a*, and thus each compliance portion 49 is individually opened to the atmosphere. Needless to say, a configuration in which the space formed in a portion between the compliance portion 49 and the cover head 130 is opened to the atmosphere is not limited thereto. Two spaces formed in a portion between the compliance portion 49 and the cover head 130 may communicate with each other and the two spaces may be opened to the atmosphere through a common path opened to the atmosphere.

Protrusion portions 140 are provided in a space formed in a portion between the compliance portion 49 and the cover head 130, as illustrated in FIG. 3. The protrusion portions 140 which regulate adhering of the sealing film 46 of the compliance portion 49 to the cover head 130 are provided in a state where the space 131 is not partitioned by the protrusion portions 140.

The protrusion portions 140 are provided to protrude, in the second direction Y, from an opening edge portion of the opening portion 48 provided in the fixing substrate 47, to an area facing the manifold 100. In Embodiment 1, the protrusion portions 140 are provided to protrude, in the second direction Y, from both sides of the opening edge portion of the opening portion 48 in the second direction Y, toward a central portion. Furthermore, a plurality of the protrusion portions 140 are provided at predetermined intervals $S_1$ in the first direction X. In other words, the protrusion portions 140 of Embodiment 1 are provided in the opening portion 48 of the fixing substrate 47 so as to have a ctenidium shape. The protrusion portions 140 which protrude, to a central portion, from both sides of the opening portion 48 in the second direction Y are disposed in a state where tip surfaces of the protrusion portions 140 face each other. Two protrusion portions 140 which face each other in the second direction Y are disposed in a state where tips of the two protrusion portions 140 are spaced apart from each other at a predetermined interval. Accordingly, a communication port 141 is formed in a portion between the two protrusion portions 140 which face each other in the second direction Y, and thus the space 131 formed in a portion between the compliance portion 49 and the cover head 130 continuously extends without being partitioned by the protrusion portions 140 in the first direction X.

Figure 6:
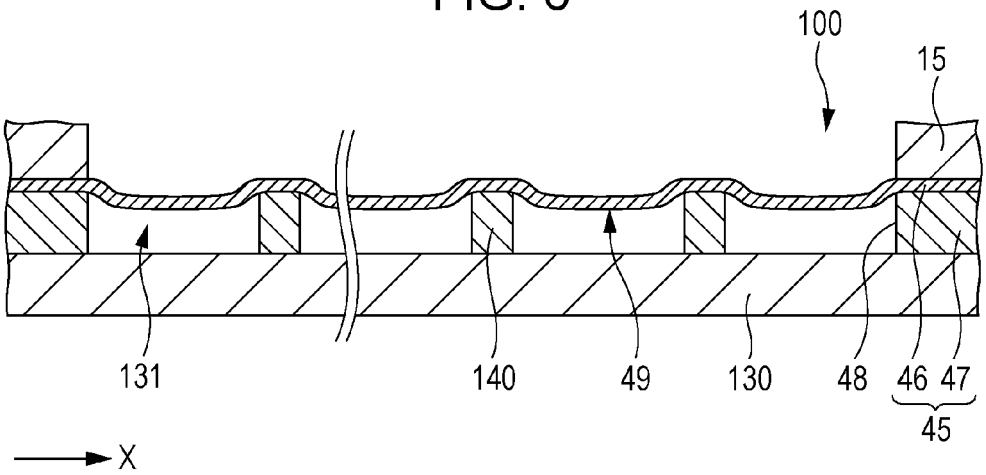
FIG. 6 is an enlarged cross-sectional view of a principal portion of the recording head according to Embodiment 1.
Figure 7:
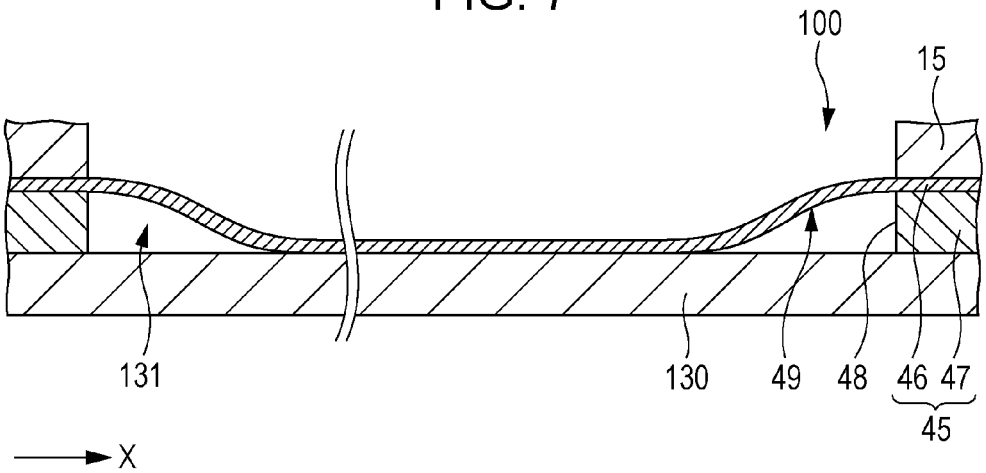
FIG. 7 is an enlarged cross-sectional view illustrating a comparative example of the recording head according to Embodiment 1.

The protrusion portions 140 are provided as described above, and thus movement of the compliance portion 49 to the cover head 130 side, which is caused by bending of the compliance portion 49, is regulated, as illustrated in FIG. 6. Therefore, it is possible to prevent the compliance portion 49 from adhering to the cover head 130. On the contrary, in a case where the protrusion portions 140 are not provided, as illustrated in FIG. 7, when the compliance portion 49 is bent, the compliance portion 49 adheres to the cover head 130. Adhering of the compliance portion 49 to the cover head 130 is caused by, for example, dew condensation.

In this case, meaning that the protrusion portions 140 are provided to regulate adhering of the sealing film 46 to the cover head 130 is that the protrusion portions 140 regulate movement of the sealing film 46 to the cover head 130 side such that, when bending of the sealing film 46 is caused at the time of manufacturing the recording head II, the sealing film 46 does not adhere to the cover head 130. The length (a protrusion amount) of the protrusion portion 140 in the second direction Y, the interval $S_1$ between the protrusion portions 140 in the first direction X, and the like are appropriately set under consideration of a bending amount of the sealing film 46 at the time of manufacturing the recording head II, an interval (a height of the space 131) between the sealing film 46 and the cover head 130, such that the sealing film 46 of the compliance portion 49 does not adhere to the cover head 130. When the length (the protrusion amount in the second direction Y) of the protrusion portion 140 is significantly short, the protrusion portion 140 regulates movement of the sealing film 46 by a less extent. Therefore, it is not possible to regulate adhering of the sealing film 46 to the cover head 130. When the length (the protrusion amount in the second direction Y) of the protrusion portion 140 is significantly long, the space 131 formed in a portion between the compliance portion 49 and the cover head 130 is completely partitioned by the protrusion portions 140. Therefore, movement of gas (pressure fluctuation) cannot occur in the partitioned space 131, and thus the compliance portion 49 does not function. In Embodiment 1, the communication port 141 is provided between two protrusion portions 140 which face each other in the second direction Y, and thus the protrusion portions 140 can prevent the compliance portion 49 (the sealing film 46) from adhering to the cover head 130, without completely partitioning the compliance portion 49.

It is preferable that the interval $S_1$ between adjacent protrusion portions 140 in the first direction X is set to a value equal to or more than a width $W_1$ of the compliance portion 49 in the second direction Y. The width $W_1$ of the compliance portion 49 in the second direction Y is a width of the compliance portion 49 in the second direction Y, in an area in which the protrusion portion 140 is not provided. That is, it is preferable that a relationship of (the interval $S_1$ between the protrusion portions 140)≥(the width $W_1$ of the compliance portion 49 in the second direction Y) be satisfied. In addition, when the interval $S_1$ between the protrusion portions 140 in the first direction X is narrower than the width $W_1$ of the compliance portion 49 in the second direction Y, the protrusion portion 140 causes deterioration of a compliance amount (an amount of absorbing pressure fluctuation in the manifold 100) of the entirety of the compliance portions 49. As a result, the pressure fluctuation in the manifold 100 is not completely absorbed, and thus this causes undesirable effects on ink discharging properties.

In a case where the width $W_2$ of the protrusion portion 140 itself in the first direction X is large, a compliance amount (which means an individual compliance amount) of the compliance portion 49 corresponding to the pressure generation chamber 12 which overlaps with the protrusion portion 140 when the protrusion portion 140 is projected in the second direction Y is reduced. In addition, the pressure fluctuation in each pressure generation chamber 12 is absorbed in such a manner that a part of the compliance portion 49, which corresponds to a portion on which the pressure generation chamber 12 is projected in the second direction Y, is deformed. Therefore, when the protrusion portion 140 is provided in the part of the compliance portion 49, the individual compliance amount of the pressure generation chamber 12 is reduced. In other words, the pressure fluctuation of the pressure generation chamber 12 which overlaps with the protrusion portions 140 in the second direction Y is absorbed by the compliance portions 49 which are located on both sides of the protrusion portion 140 in the first direction X. Therefore, when the width $W_2$ of the protrusion portion 140 in the first direction X is large, the individual compliance amount of the pressure generation chamber 12 which overlaps with the protrusion portions 140 in the second direction Y is significantly reduced. Accordingly, the pressure fluctuation cannot be absorbed, and thus it is not possible to uniformize discharging properties of ink droplets which are discharged through a plurality of the nozzle openings 21. As a result, the discharging properties are uneven. Thus, it is preferable that the width $W_2$ of the protrusion portion 140 in the first direction X be set to a value in which strength capable of regulating movement (deformation) of the compliance portion 49 to the cover head 130 side is ensured. Furthermore, it is preferable that the width $W_2$ thereof be set to an as small as possible value such that the individual compliance amount is not significantly reduced.

The protrusion portions 140 of Embodiment 1 are arranged to face each other in the second direction Y. In other words, adjacent protrusion portions 140 in the second direction Y are arranged in positions in which the adjacent protrusion portions 140 overlap each other when one protrusion portion 140 is projected on the other protrusion portion 140 in the second direction Y. Thus, the length (the protrusion amount) of the protrusion portion 140 in the second direction Y defines a size of the width $W_3$ of the communication port 141 (in the second direction Y). In this case, the width $W_3$ of the communication port 141 may be set to a value in which gases in the spaces located on both sides of two protrusion portions 140 can flow in the second direction Y, without any obstruction. In other words, when two protrusion portions 140 are continuously provided in the second direction Y, without providing the communication port 141, the space is completely partitioned, in the second direction Y, by the protrusion portions provided continuously in the second direction Y. Thus, gas in the partitioned space is not opened to the atmosphere. As a result, the compliance portion 49 does not function. That is, meaning that the space is partitioned by the protrusion portions is that gases in two partitioned spaces cannot flow to each other. In Embodiment 1, the communication port 141 is provided, and thus the space is not completely partitioned by the protrusion portions 140 and it is possible to prevent the compliance portion 49 from not functioning. In addition, to cause the compliance portion 49 to fully function, it is preferable that the width $W_3$ of the communication port 141 is set to a value in which the communication port 141 does not obstruct flowing of gas. The reason for this will be described below. That is, when the flowing of gas is obstructed due to the small width $W_3$ of the communication port 141, it is difficult for the compliance portion 49 to be bent, and thus the pressure fluctuation of the manifold 100 cannot be absorbed.

As described above, even when the compliance amount of the entirety of the compliance portions 49 is great, the individual compliance amount of the compliance portion 49 may be partially and significantly reduced. The width of the protrusion portion 140 (in the first direction X) and the length of the protrusion portion 140 (in the second direction Y) particularly affect the individual compliance amount. The number of the protrusion portions 140 and the width between adjacent protrusion portions 140 particularly affect the entire compliance amount. Thus, it is preferable that the width $W_2$ or the length of each protrusion portion 140, the number of the protrusion portions 140, and the interval $S_1$ between the protrusion portions 140 be appropriately set under consideration of the individual compliance amount and the entire compliance amount.

In the ink jet type recording head II configured as above, when the ink is ejected, the ink is sent from an ink cartridge 2 through the introduction path 44. Then, a flow path from the manifold 100 to the nozzle openings 21 is filled with the ink. Next, voltage is applied, based on a signal from the driving circuit 120, to each piezoelectric actuator 300 corresponding to the pressure generation chamber 12, and thus the diaphragm 50 and the piezoelectric actuator 300 are deformed in a bent manner. Accordingly, the pressure in the pressure generation chamber 12 increases, and thus ink droplets are ejected from a predetermined nozzle opening 21.

In this case, pressure fluctuation is caused in the manifold 100 due to supply of ink to the manifold 100 and pressure fluctuation in the pressure generation chamber 12. However, the pressure fluctuation is absorbed in such a manner that the compliance portion 49 is deformed in a bent manner.

In Embodiment 1, the protrusion portions 140 are provided in the space 131 formed in a portion between the compliance portion 49 and the cover head 130, and thus it is possible to prevent the compliance portion 49 from adhering to the cover head 130, in a state where the compliance amount (the amount of absorbing pressure fluctuation) of the compliance portion 49, which is obtained by bending deformation of the compliance portion 49, is not significantly reduced. Therefore, the compliance portion 49 is prevented from adhering to the cover head 130, and thus it is possible to prevent pressure fluctuation in the manifold 100 from not being absorbed and causing undesirable effects on ink discharging properties.

Embodiment 2

Figure 8:
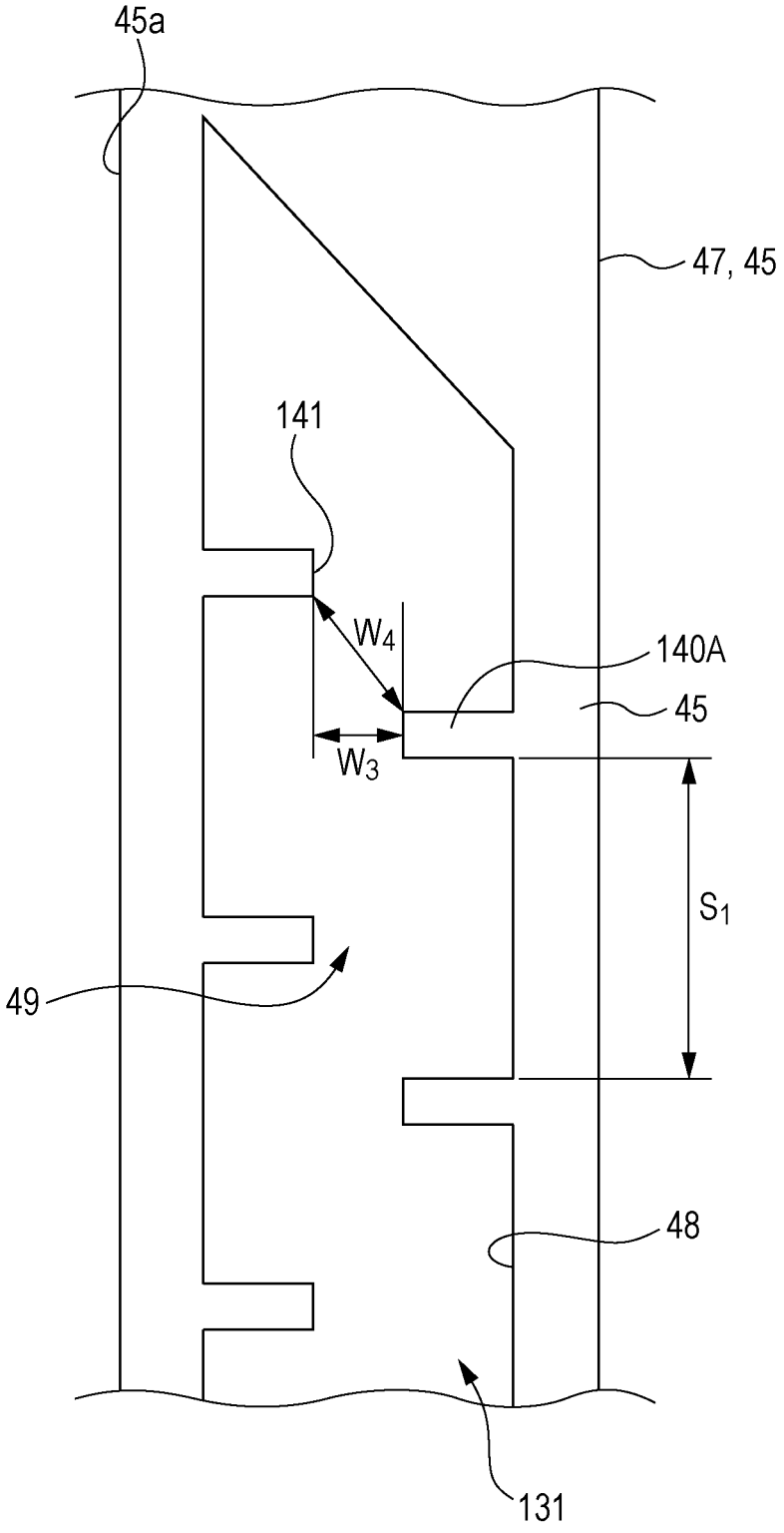
FIG. 8 is an enlarged plan view of a principal portion of a compliance substrate according to Embodiment 2.

FIG. 8 is a plan view illustrating a compliance substrate according to Embodiment 2 of the invention. In addition, the same reference numerals and letters are given to the same members as those in Embodiment 1, and the same descriptions as those in Embodiment 1 will not be repeated.

Protrusion portions 140A which regulate adhering of the compliance portion 49 to the cover head 130 are provided in the space 131 formed in a portion between the compliance portion 49 and the cover head 130, as illustrated in FIG. 8.

The protrusion portions 140A of Embodiment 2 are provided to protrude, in the second direction Y, from an opening edge portion of the opening portion 48 provided in the fixing substrate 47, to an area facing the manifold 100. In Embodiment 2, the protrusion portions 140A protrude, in the second direction Y, from both sides of the opening edge portion of the opening portion 48 in the second direction Y, toward a central portion. Furthermore, a plurality of the protrusion portions 140A are provided at predetermined intervals $S_1$ in the first direction X. In other words, the protrusion portions 140A of Embodiment 2 are provided in the opening portion 48 of the fixing substrate 47 so as to have a ctenidium shape. The protrusion portions 140A which protrude, to a central portion, from both sides of the opening portion 48 in the second direction Y are disposed in a state where the protrusion portions 140A are disposed to be staggered away from each other so as not to face each other. Two protrusion portions 140A are disposed in a state where tips thereof are spaced apart from each other at a predetermined interval. Accordingly, a communication port 141 is formed in a portion between the two protrusion portions 140 aligned in the second direction Y, and thus the space 131 formed in a portion between the compliance portion 49 and the cover head 130 is continuously formed without being partitioned by the protrusion portions 140A in the second direction Y.

In other words, in Embodiment 2, two protrusion portions 140A aligned in the second direction Y are staggered in the first direction X, and thus a width $W_4$ of the communication port 141 which is opened between tips of the two protrusion portions 140A can be set to be wider than the width $W_3$ in a case where tip surfaces face each other. That is, even in a case of the protrusion portion 140A of which lengths in the second direction Y are the same, two protrusion portions 140A are arranged in positions in which the two protrusion portions 140A do not overlap when one protrusion portion 140A is projected onto the other protrusion portion 140A. Therefore, it is possible to easily enlarge an interval between the protrusion portions 140A, that is, the width $W_4$ of the communication port 141. As a result, it is possible to ensure the width $W_4$ of the communication port 141, without reducing the length of the protrusion portion 140A (in the second direction Y) so as not to reduce an amount of regulating movement of the compliance portion 49 to the cover head 130 side.

Embodiment 3

Figure 9:
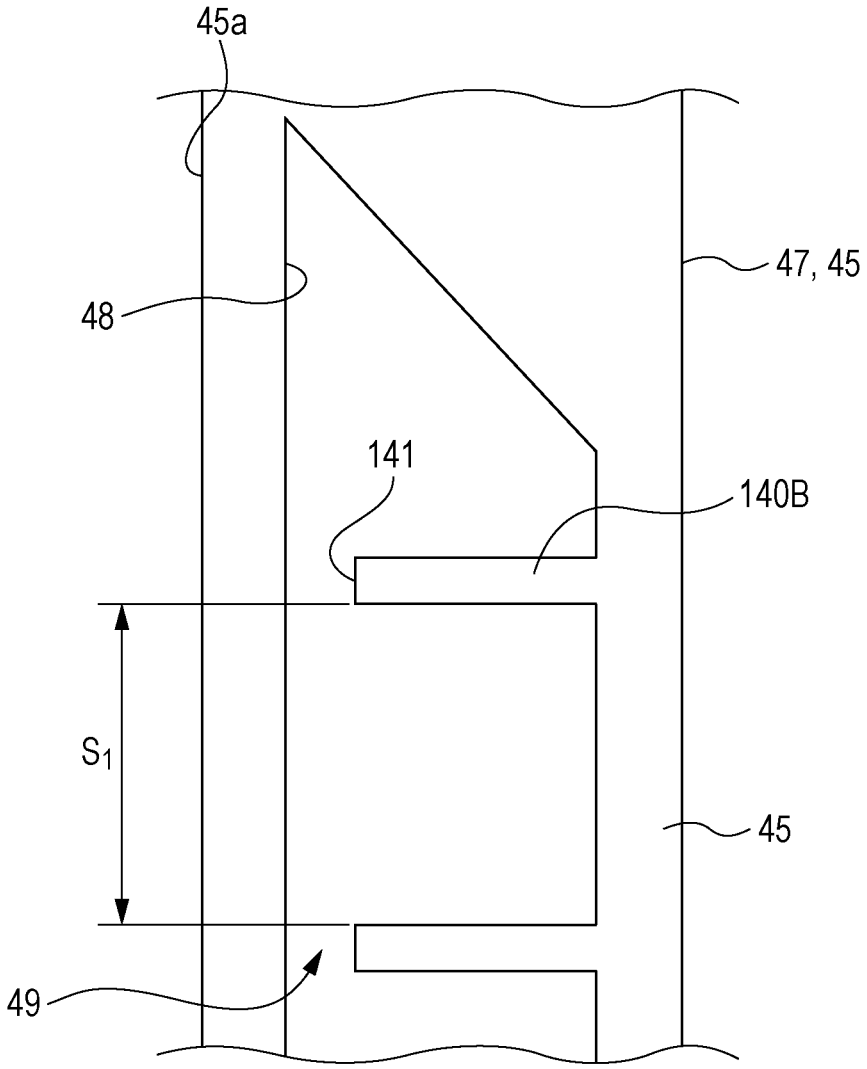
FIG. 9 is an enlarged plan view of a principal portion of a compliance substrate according to Embodiment 3.
Figure 10:
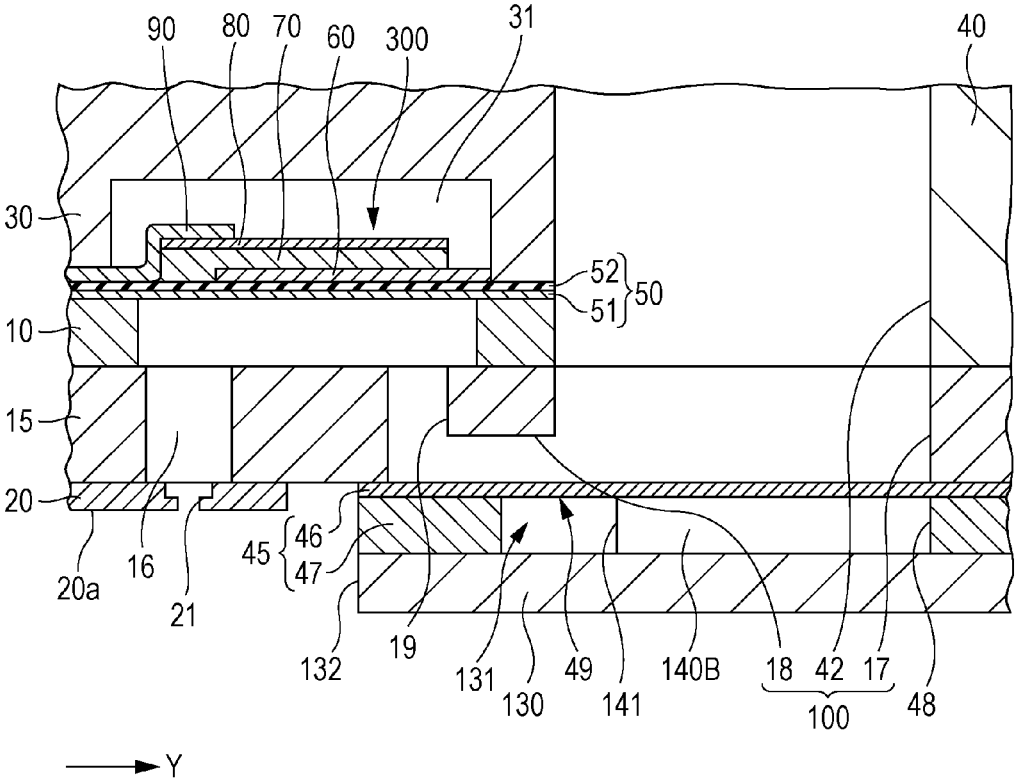
FIG. 10 is an enlarged cross-sectional view of a principal portion of a recording head according to Embodiment 3.

FIG. 9 is a plan view illustrating a compliance substrate according to Embodiment 3 of the invention. FIG. 10 is an enlarged cross-sectional view of a principal portion of an ink jet type recording head as an example of a liquid ejecting head according to Embodiment 3 of the invention. In addition, the same reference numerals and letters are given to the same members as those in Embodiments 1 and 2, and the same descriptions as those in Embodiments 1 and 2 will not be repeated.

A protrusion portion 140B which regulates adhering of the compliance portion 49 to the cover head 130 is provided in the space 131 formed in a portion between the compliance portion 49 and the cover head 130, as illustrated in FIGS. 9 and 10.

The protrusion portion 140B of Embodiment 3 is provided to protrude, in the second direction Y, from an opening edge portion of the opening portion 48 provided in the fixing substrate 47, to an area facing the manifold 100. In Embodiment 3, the protrusion portion 140 protrudes, in the second direction Y, from one side of the opening edge portion of the opening portion 48 in the second direction Y, toward a central portion. In Embodiment 3, the protrusion portion 140B protrudes, to a supply communication path 19 side, from an opening edge portion which is located on a side opposite to the supply communication path 19 that allows the manifold 100 to communicate with the pressure generation chamber 12. In other words, the communication port 141 is formed between a tip of the protrusion portion 140B and the opening edge portion, and the communication port 141 is disposed close to the supply communication path 19 side.

The protrusion portion 140B is configured as described above. As a result, when the compliance portion 49 of the manifold 100 absorbs pressure fluctuation in such a manner that the compliance portion 49 is deformed due to a pressure change in the pressure generation chamber 12, it is possible to prevent the protrusion portion 140B from deteriorating an individual compliance amount of the compliance portion 49.

In other words, the pressure fluctuation in each pressure generation chamber 12 is absorbed by deforming a part of the compliance portion 49, which corresponds to a portion on which the pressure generation chamber 12 is projected in the second direction Y, as described above. Therefore, when a protrusion portion is provided in the part of the compliance portion 49, an individual compliance amount of the pressure generation chamber 12 is reduced. However, in Embodiment 3, the protrusion portion 140B is not provided in a portion closest to the supply communication path 19 which communicates with the pressure generation chamber 12. Therefore, the pressure fluctuation in the pressure generation chamber 12 can be absorbed in such a manner that the compliance portion 49 between the protrusion portion 140B and an opening edge portion is deformed. As a result, an individual compliance amount of each pressure generation chamber 12 is uniformized by providing the protrusion portion 140B on a side opposite to the supply communication path 19. Accordingly, it is possible to uniformize ink-droplet discharging properties. In addition, it is possible to increase the width $W_1$ (see FIG. 3) of the protrusion portion 140B.

A plurality of protrusion portions 140B are provided in the first direction X, at predetermined intervals $S_1$.

Embodiment 4

Figure 11:
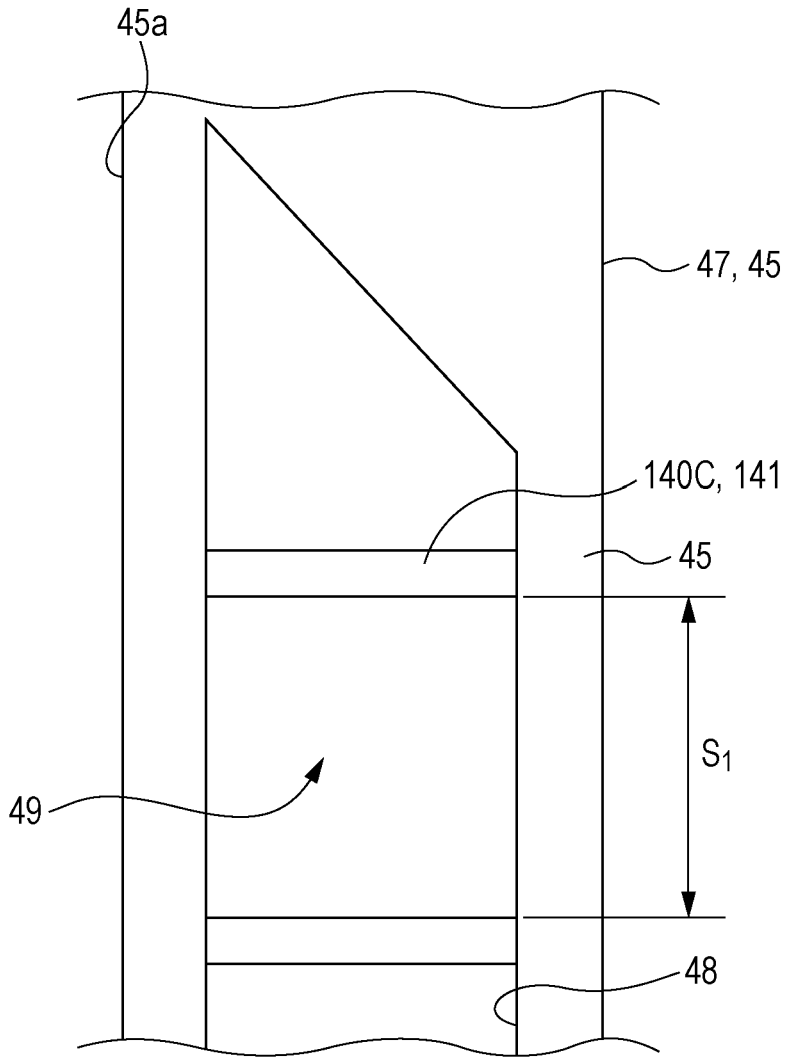
FIG. 11 is an enlarged plan view of a principal portion of a compliance substrate according to Embodiment 4.
Figure 12:
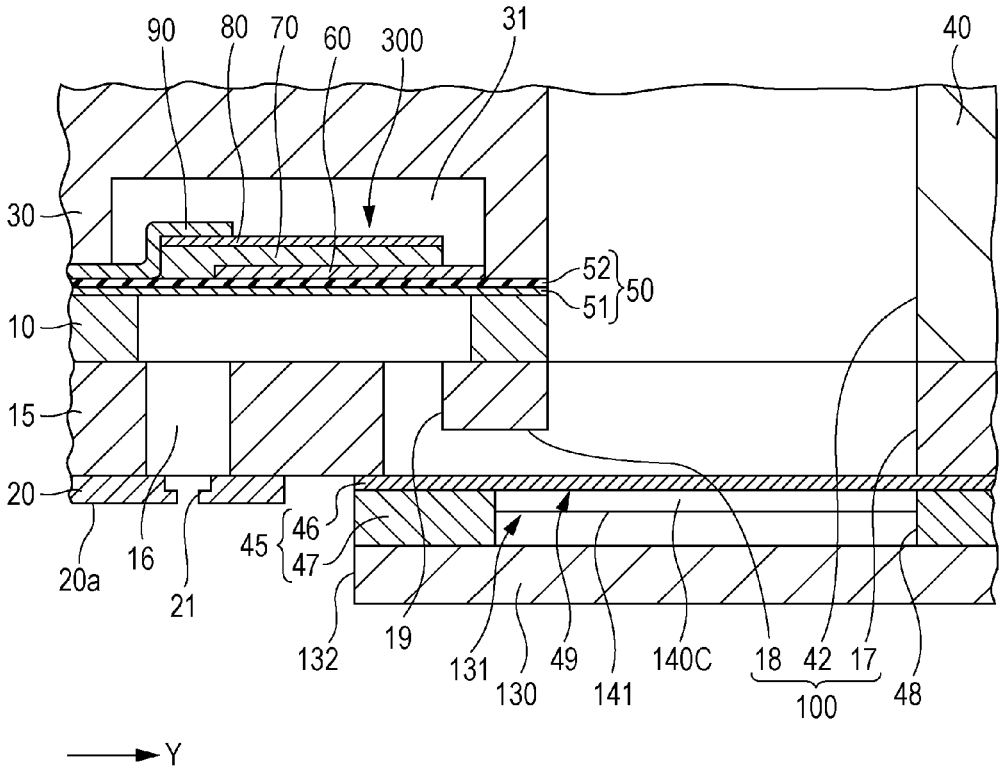
FIG. 12 is an enlarged cross-sectional view of a principal portion of a recording head according to Embodiment 4.

FIG. 11 is a plan view of a compliance substrate according to Embodiment 4 of the invention. FIG. 12 is an enlarged cross-sectional view of a principal portion of an ink jet type recording head as an example of a liquid ejecting head according to Embodiment 4 of the invention. In addition, the same reference numerals and letters are given to the same members as those in Embodiments 1 to 3, and the same descriptions as those in Embodiments 1 to 3 will not be repeated.

A protrusion portion 140C which regulates adhering of the compliance portion 49 to the cover head 130 is provided in the space 131 formed in a portion between the compliance portion 49 and the cover head 130, as illustrated in FIGS. 11 and 12.

The protrusion portion 140C of Embodiment 4 is provided to continuously extend, in the second direction Y, from an opening edge portion of the opening portion 48, which is provided in the fixing substrate 47, to an opening edge portion on an opposite side. Furthermore, the protrusion portion 140C is provided on the sealing film 46 side so as not to extend to the cover head 130. Thus, a communication port 141 is formed between the protrusion portion 140C and the cover head 130. A plurality of the protrusion portions 140C are provided in the first direction X at predetermined intervals $S_1$.

Even when the protrusion portion 140C configured as above is provided in the fixing substrate 47, it is possible to prevent the compliance portion 49 from adhering to the cover head 130, by the protrusion portion 140C. In addition, it is possible to prevent the space 131 from being completely partitioned by the protrusion portion 140C, and thus the space 131 can continuously extend through the communication port 141. As a result, it is possible to prevent a function of the compliance portion 49 from being deteriorated.

Embodiment 5

Figure 13:
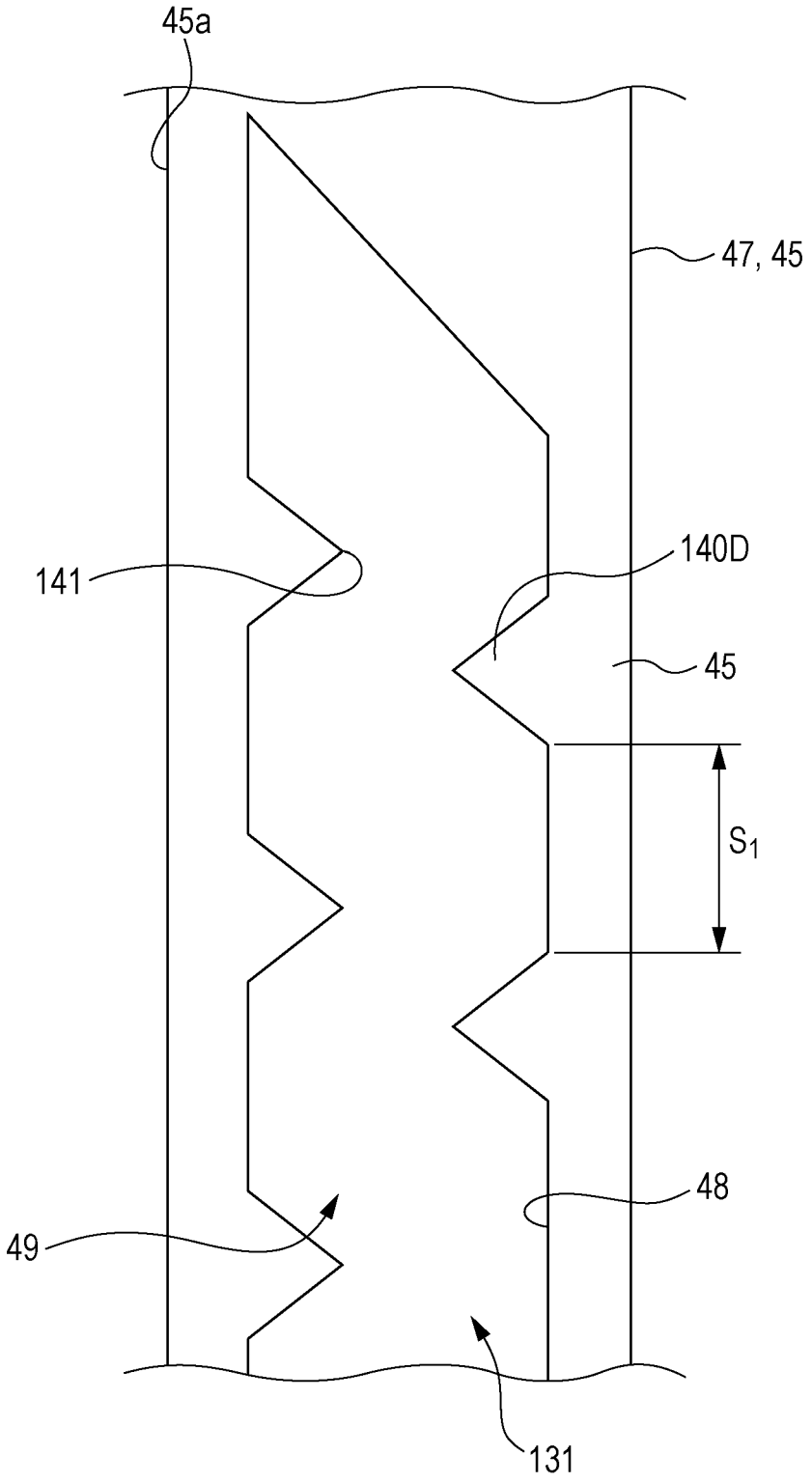
FIG. 13 is an enlarged plan view of a principal portion of a compliance substrate according to Embodiment 5.

FIG. 13 is a plan view of a compliance substrate according to Embodiment 5 of the invention. In addition, the same reference numerals and letters are given to the same members as those in Embodiments 1 to 4, and the same descriptions as those in Embodiments 1 to 4 will not be repeated.

In Embodiments 1 to 3, the protrusion portions 140, 140A, 140B, or 140C are provided to protrude by the same width in the second direction Y. However, a protrusion portion 140D of Embodiment 5 is formed such that a width of the protrusion portion 140D in the first direction X is gradually narrowed as the protrusion portion 140D moves from a base end portion side to a tip portion side which protrudes in the second direction Y, as illustrated in FIG. 13. Furthermore, in Embodiment 5, lateral surfaces (surfaces on both sides in the first direction X) of the protrusion portion 140D are formed to be flat inclined surfaces. However, a shape of the lateral surface is not limited thereto. The lateral surface may be formed in a curved surface shape (including both a convex surface and a concave surface).

Similarly to Embodiment 2 described above, two protrusion portions 140D are arranged in positions in which the two protrusion portions 140D do not overlap from the both sides of the second direction Y in the opening edge portion of the opening portion 48 when one protrusion portion 140D is projected on the other protrusion portion 140D. Furthermore, a plurality of the protrusion portions 140D are aligned in the first direction X at intervals $S_1$.

The protrusion portion 140D configured as above is provided in the fixing substrate 47, and thus it is possible to prevent the compliance portion 49 from adhering to the cover head 130. In addition, the width of the protrusion portion 140D is gradually narrowed as the protrusion portion 140D moves close to the tip portion, and thus it is possible to prevent an individual compliance amount from being reduced. Therefore, it is possible to uniformize ink discharging properties. Furthermore, the width of the protrusion portion 140D in the first direction X is gradually widened as the protrusion portion 140D moves from the tip portion side to the base end portion side, that is, the base end portion side of a protrusion is gradually widened with respect to the tip portion side. Therefore, it is possible to increase the hardness of the protrusion portion 140D. A width widening shape of the protrusion portion 140D is not limited to the shape described above, and the width thereof may be stepwisely widened.

Embodiment 6

Figure 14:
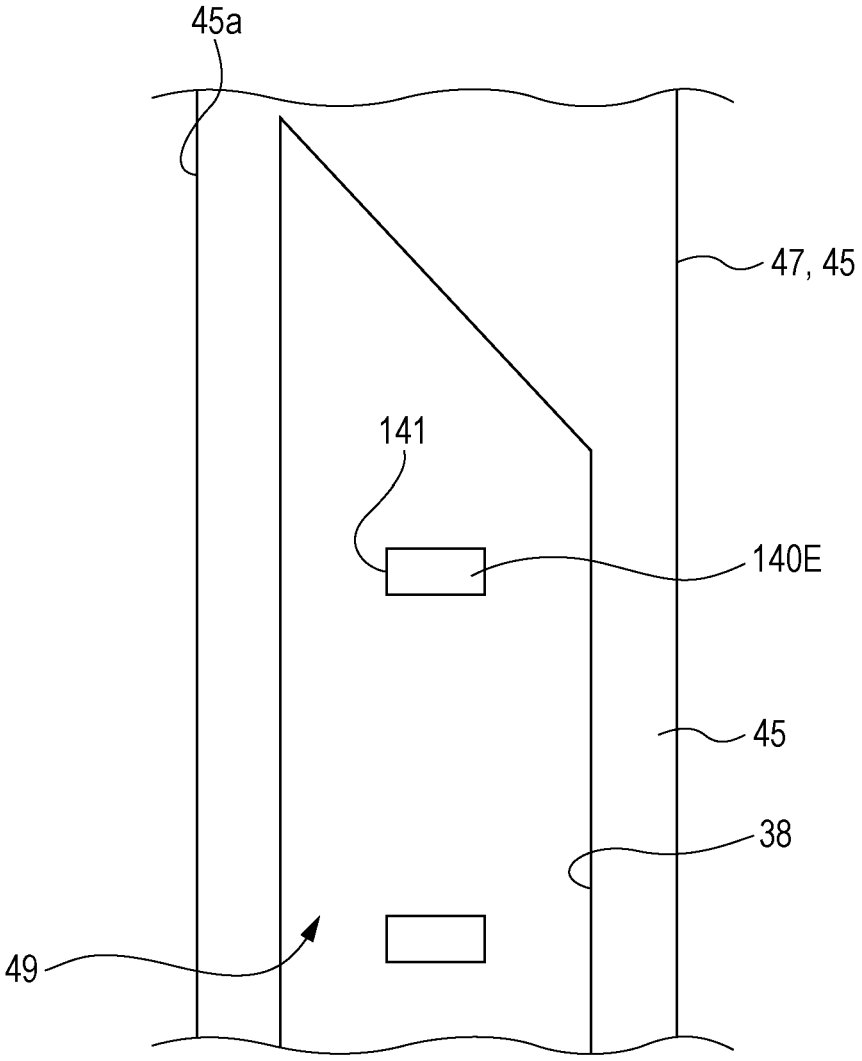
FIG. 14 is an enlarged plan view of a principal portion of a compliance substrate according to Embodiment 6.

FIG. 14 is a plan view of a compliance substrate according to Embodiment 6 of the invention. In addition, the same reference numerals and letters are given to the same members as those in Embodiments 1 to 5, and the same descriptions as those in Embodiments 1 to 5 will not be repeated.

A protrusion portion 140E which regulates adhering of the compliance portion 49 to the cover head 130 is provided in the space 131 formed in a portion between the compliance portion 49 and the cover head 130, as illustrated in FIG. 14.

A protrusion portion 140E is formed in an island shape and is provided not to be continuous with an opening edge portion of the opening portion 48. Therefore, communication ports 141 are respectively provided on both sides of the protrusion portion 140E in the second direction Y.

The protrusion portion 140E configured as above is provided in fixing substrate 47, and thus it is possible to prevent the compliance portion 49 from adhering to the cover head 130. Similarly to Embodiment 3 described above, the protrusion portion 140E has a communication port 141 on the supply communication path 19 side, and thus, it is possible to prevent an individual compliance amount from being reduced. As a result, it is possible to uniformize ink discharging properties.

Embodiment 7

Figure 15:
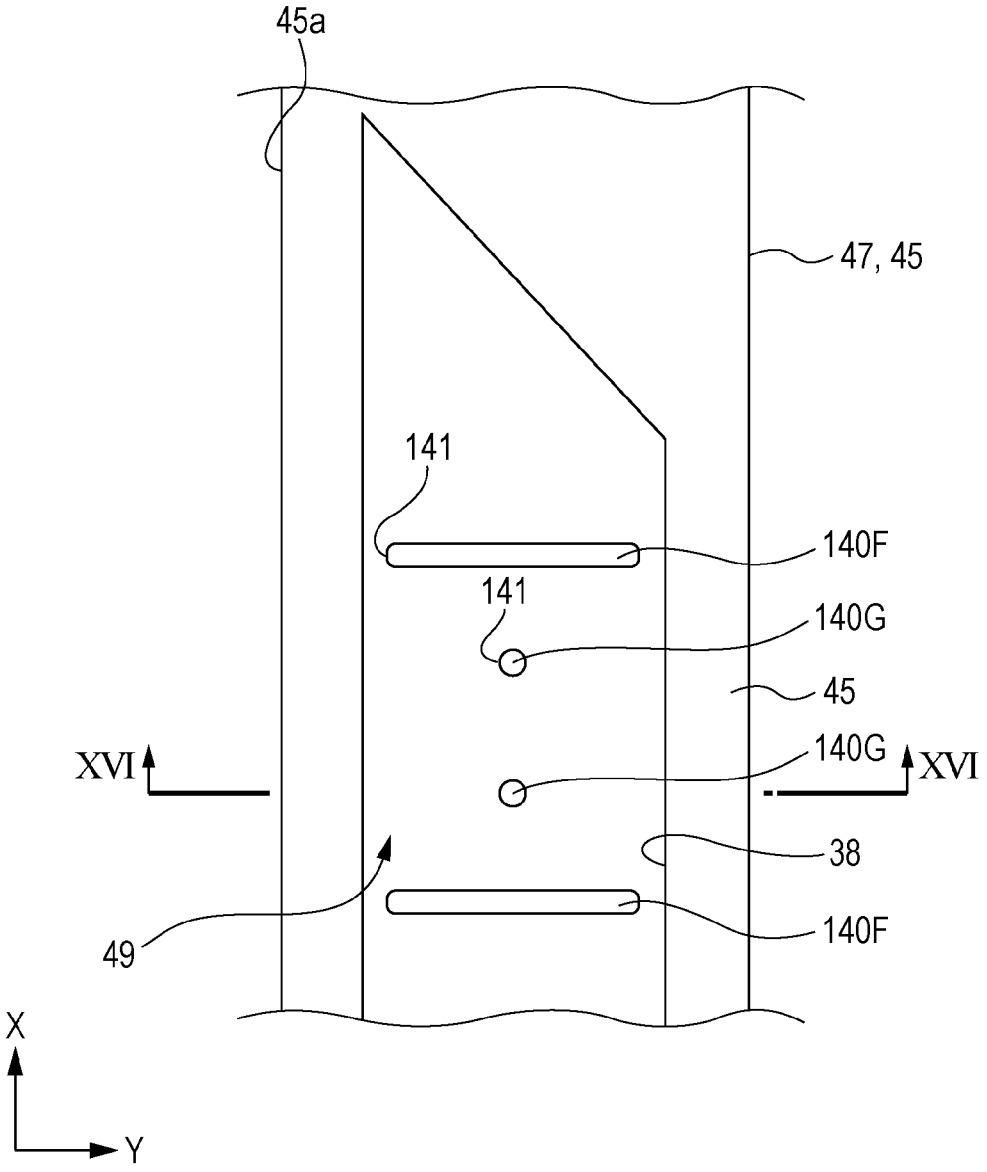
FIG. 15 is an enlarged plan view of a principal portion of a compliance portion according to Embodiment 7.
Figure 16A:
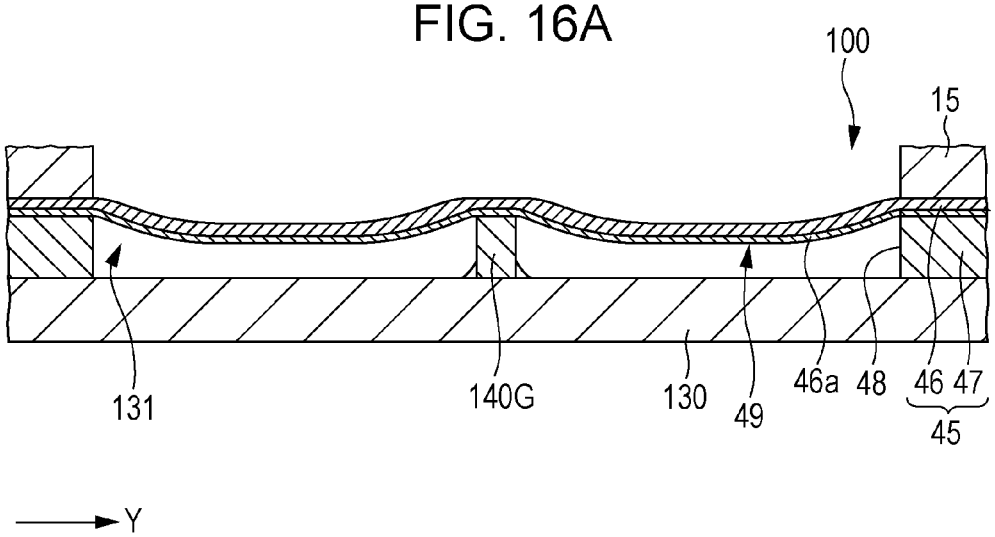
FIGS. 16A and 16B are enlarged cross-sectional views of a principal portion of the compliance portion according to Embodiment 7.
Figure 16B:
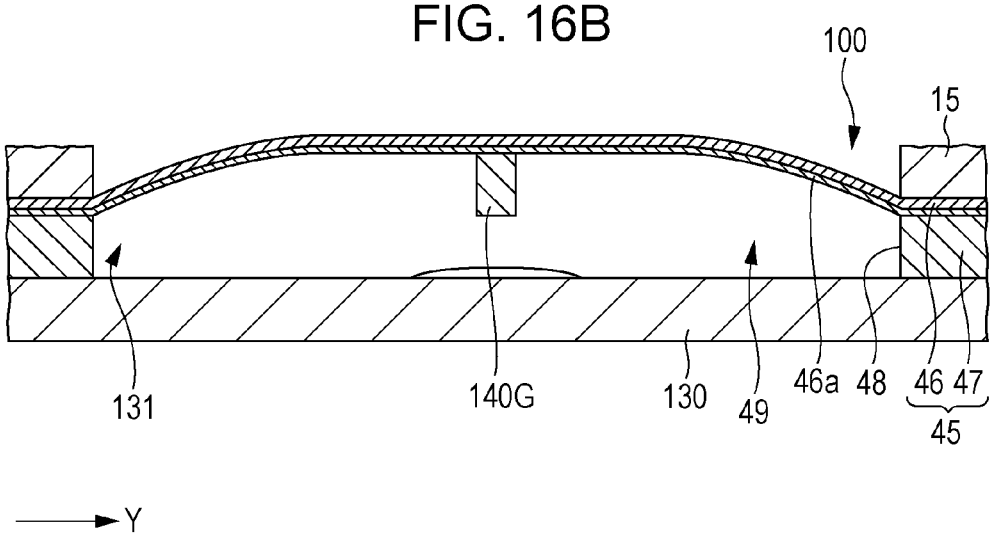

FIG. 15 is a plan view of a compliance substrate according to Embodiment 7 of the invention. FIGS. 16A and 16B are cross-sectional views taken along line XVI-XVI in FIG. 15. In addition, the same reference numerals and letters are given to the same members as those in Embodiments 1 to 6, and the same descriptions as those in Embodiments 1 to 6 will not be repeated.

Protrusion portions 140F and 140G which regulate adhering of the compliance portion 49 to the cover head 130 are provided in the space 131 formed in a portion between the compliance portion 49 and the cover head 130, as illustrated in FIG. 15.

The protrusion portions 140F and 140G are formed in an island shape and provided not to be continuous with an opening edge portion of the opening portion 48. In other words, the protrusion portions 140F and 140G are provided in a state where the protrusion portions are not fixed to the fixing substrate 47. Thus, communication ports 141 are respectively provided on both sides of the protrusion portions 140F and 140G in the second direction Y.

In this case, the protrusion portion 140F is formed in a shape extending in the second direction Y. The respective communication ports 141 of the protrusion portion 140F, which are provided on both sides in the second direction Y and are gaps between the protrusion portion 140F and the opening edge portion of the opening portion 48, are narrower than the respective communication ports 141 of the protrusion portion 140G. A plurality of the protrusion portions 140F are provided in the first direction X at predetermined intervals.

The protrusion portion 140G has a shape in which a length of the protrusion portion 140G in the second direction Y is shorter than that of the protrusion portion 140F. In Embodiment 7, the protrusion portion 140G has a cylindrical shape. Two protrusion portions 140G are aligned, in the first direction X, between adjacent protrusion portions 140F in the first direction X. The protrusion portion 140G is provided in a center portion of the compliance portion 49 in the second direction Y.

The protrusion portions 140F and 140G configured as above are provided in a state where the protrusion portions are adhered to the compliance portion 49 and are not fixed to the cover head 130 as a cap member. In other words, the protrusion portions 140F and 140G are held in a state where the protrusion portions are adhered to only the compliance portion 49.

In this case, the sealing film 46 forming the compliance portion 49 has an adhesion layer 46*a* on the fixing substrate 47 side. The adhesion layer 46*a* is constituted by an adhesive. The compliance substrate 45 is produced by the following procedure. The entirety of an adhesion surface of either the sealing film 46 or the fixing substrate 47 on which the opening portion 48 is not formed is adhered, using an adhesive, to the other adhesion surface, or adhesion surfaces of both the sealing film 46 and the fixing substrate 47 are adhered, using an adhesive, to each other. Then, the opening portion 48 is formed in the fixing substrate 47 in such a manner that the fixing substrate 47 is subjected to, for example, etching. Therefore, the adhesion layer 46*a* which is formed by a cured adhesive is provided on a surface side of the sealing film 46, which faces the opening portion 48.

Examples of an adhesive which is used for causing the sealing film 46 to be adhered to the fixing substrate 47 include an urethane-based adhesive and an epoxy adhesive. Moisture contained in the ink in the manifold 100 passes through the sealing film 46 and enters the space 131 formed in a portion between the compliance portion 49 and the cover head 130. In addition, moisture contained in the atmosphere enters the space 131 because the space 131 is opened to the atmosphere, as described above. Therefore, viscidity of the adhesion layer 46*a* which is provided on the surface side of the sealing film 46, which faces the opening portion 48, is recovered by temperature and humidity. Accordingly, when the compliance portion 49 adheres to the cover head 130, it is difficult to easily separate the compliance portion 49 from the cover head 130, due to the viscidity of the adhesion layer 46*a*. Furthermore, even in a case where the adhesion layer 46*a* is not formed in a portion corresponding to the opening portion 48, the compliance portion 49 is adhered to the cover head 130 by moisture. However, in this case, strength of adhesion of the compliance portion 49 to the cover head 130 is determined by surface tension corresponding to an adhered area. Thus, when the compliance portion 49 is adhered to the cover head 130, it is not possible to separate the compliance portion 49 from the cover head 130 only in such a manner that a pressure in the manifold 100 is changed to a negative pressure by discharging the ink.

In Embodiment 7, the protrusion portions 140F and 140G are provided in the compliance substrate 45, and thus movement of the compliance portion 49 to the cover head 130 side due to bending of the compliance portion 49 is regulated, as illustrated in FIG. 16A. As a result, it is possible to prevent the compliance portion 49 from adhering to the cover head 130.

Furthermore, in Embodiment 7, the protrusion portions 140F and 140G are separately provided so as not to be continuous with the opening edge portion of the opening portion 48, and thus the protrusion portions 140F and 140G are not fixed to the cover head 130. Therefore, when the pressure in the manifold 100 is changed to the negative pressure by discharging ink, the protrusion portions 140F and 140G move to follow the bending deformation of the compliance portion 49, as illustrated in FIG. 16B. Therefore, the protrusion portions 140F and 140G are prevented from hindering the bending deformation of the compliance portion 49 to the manifold 100, and thus it is possible to cause the compliance portion 49 to function desirably when the pressure in the manifold 100 is changed.

Figure 17:
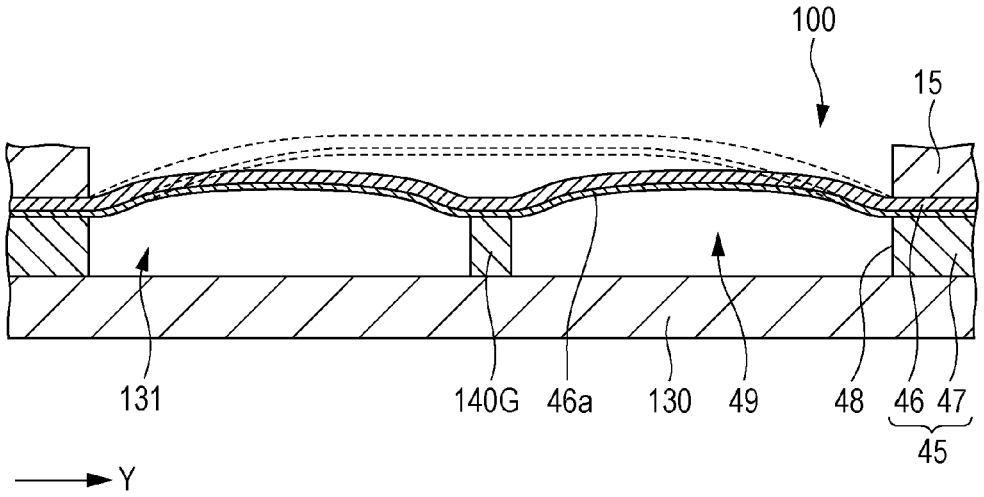
FIG. 17 is a cross-sectional view of a compliance portion, which illustrates a comparative example of Embodiment 7.

On the contrary, in a case where the protrusion portions 140F and 140G adhere to the cover head 130, as illustrated in FIG. 17, when the compliance portion 49 is deformed to be bent to the manifold 100, the protrusion portions 140F and 140G cannot move to follow the bending deformation of the compliance portion 49. Therefore, the protrusion portions 140F and 140G regulate the movement of the compliance portion 49, and thus the compliance portion 49 cannot be deformed to be bent adequately.

In addition, in Embodiment 7, the protrusion portions 140F and 140G of different types are provided in the compliance substrate 45. Accordingly, a part of the compliance portion 49, which is an area regulated by the protrusion portions 140F and 140G, that is, an area which does not function as the compliance portion 49, is reduced as much as possible. Therefore, it is possible to prevent the compliance portion 49 from adhering to the cover head 130. In other words, a plurality of the protrusion portions 140F extending in the second direction Y are aligned in the first direction X, and thus it is possible to prevent the entirety of the compliance portion 49 from adhering to the cover head 130. Furthermore, the protrusion portion 140G is provided in the compliance substrate 45. Thus, in a portion between adjacent protrusion portions 140F in the first direction X, it is possible to prevent the compliance portion 49 from adhering to the cover head 130. Incidentally, it is possible to conceive a configuration in which the protrusion portion 140G is substituted by the protrusion portion 140F. When all protrusion portions 140G are substituted by the protrusion portions 140F, it is possible to prevent the compliance portion 49 from adhering to the cover head 130. However, a part of the compliance portion 49, which does not become deformed, increases, and this results in functional deterioration of the compliance portion 49.

When the protrusion portions 140F and 140G are constituted by the same material as the fixing substrate 47, it is possible to reduce costs by reducing the number of components. In other words, when the opening portion 48 and the protrusion portions 140F and 140G are formed in such a manner that the sealing film 46 and the fixing substrate 47 on which the opening portion 48 is not formed are adhered using an adhesive, and then the fixing substrate 47 is subjected to etching, it is possible to form the protrusion portions 140F and 140G at low cost, without an increase in the number of components. Furthermore, the protrusion portions 140F and 140G can be easily formed with high accuracy, in such a manner that the fixing substrate 47 is subjected to etching.

Needless to say, the protrusion portions 140F and 140G may be constituted by a material different from the fixing substrate 47. In other words, the protrusion portions 140F and 140G which are separately formed may be adhered to the compliance substrate 45 on which the opening portion 48 is formed. Furthermore, in a case where the protrusion portions 140F and 140G are formed in an island shape, that is, the protrusion portions 140F and 140G being separated so as not to be continuous with the opening edge portion of the opening portion 48, the protrusion portions 140F and 140G may be provided on the cover head 130 so as not to adhere to the sealing film 46.

Embodiment 8

Figure 18:
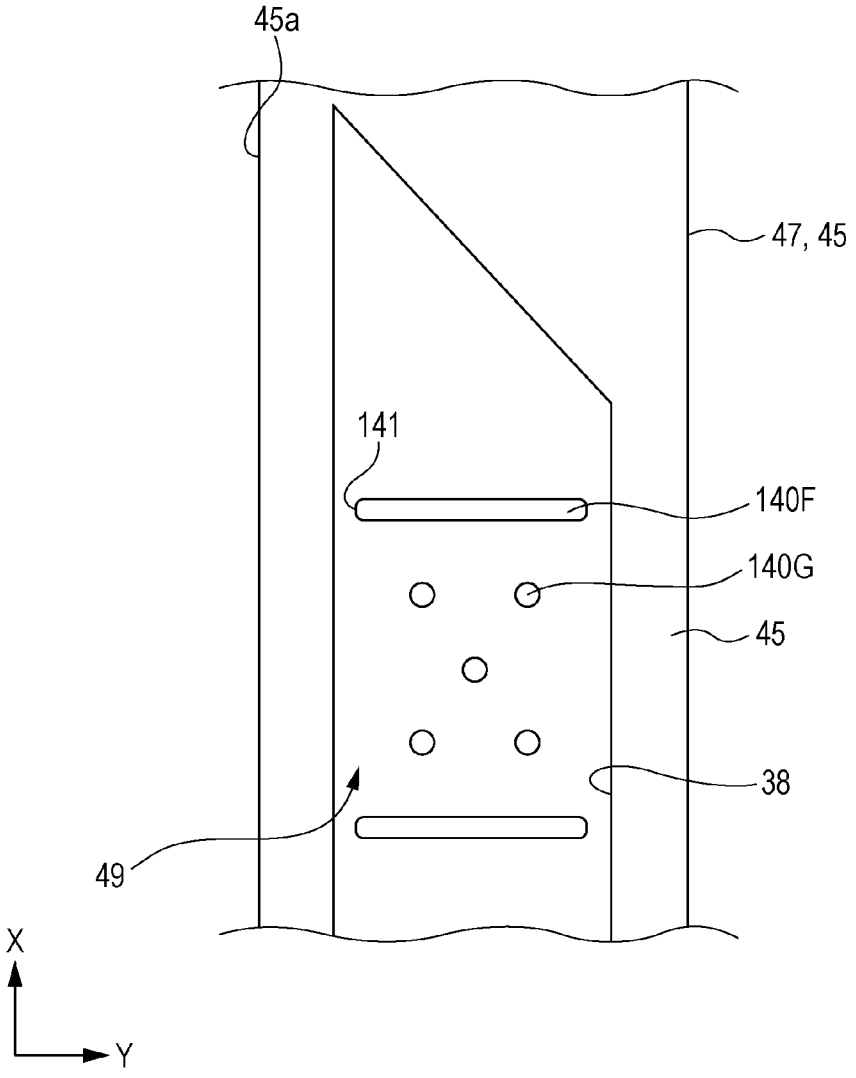
FIG. 18 is an enlarged plan view of a principal portion of a compliance portion according to Embodiment 8.

FIG. 18 is a plan view of a compliance substrate according to Embodiment 8 of the invention. The same reference numerals and letters are given to the same members as those in Embodiments 1 to 7, and the same descriptions as those in Embodiments 1 to 7 will not be repeated.

Protrusion portions 140F and 140G which regulate adhering of the compliance portion 49 to the cover head 130 are provided in the space 131 formed in a portion between the compliance portion 49 of Embodiment 8 and the cover head 130, as illustrated in FIG. 18.

Similarly to Embodiment 7 described above, the protrusion portions 140F and 140G are formed in an island shape and provided not to be continuous with the opening edge portion of the opening portion 48. Therefore, the communication ports 141 are respectively provided on both sides of the protrusion portions 140F and 140G in the second direction Y.

In this case, similarly to Embodiment 7 described above, the protrusion portion 140F has a shape extending in the second direction Y. A plurality of the protrusion portions 140F are arranged, one after another, in the first direction X, at predetermined intervals.

Five protrusion portions 140G are provided between adjacent protrusion portions 140F in the first direction X. In Embodiment 8, a pair of the protrusion portions 140G aligned in the second direction Y and one protrusion portion 140G are alternately arranged in the first direction X. The pair of protrusion portions 140G aligned in the second direction Y are arranged in a state where gaps between the protrusion portions 140G and the opening edge portion of the opening portion 38 and a gap between the protrusion portions 140G are divided into three equal intervals in the second direction Y. In this case, the one protrusion portion 140G is disposed in a center portion of the space 131 in the second direction Y.

Five protrusion portions 140G are provided between adjacent protrusion portions 140F in the first direction X, as described above. Thus, in a portion between adjacent protrusion portions 140F in the first direction X, it is possible to reliably prevent the compliance portion 49 from adhering to the cover head 130.

Embodiment 9

Figure 19:
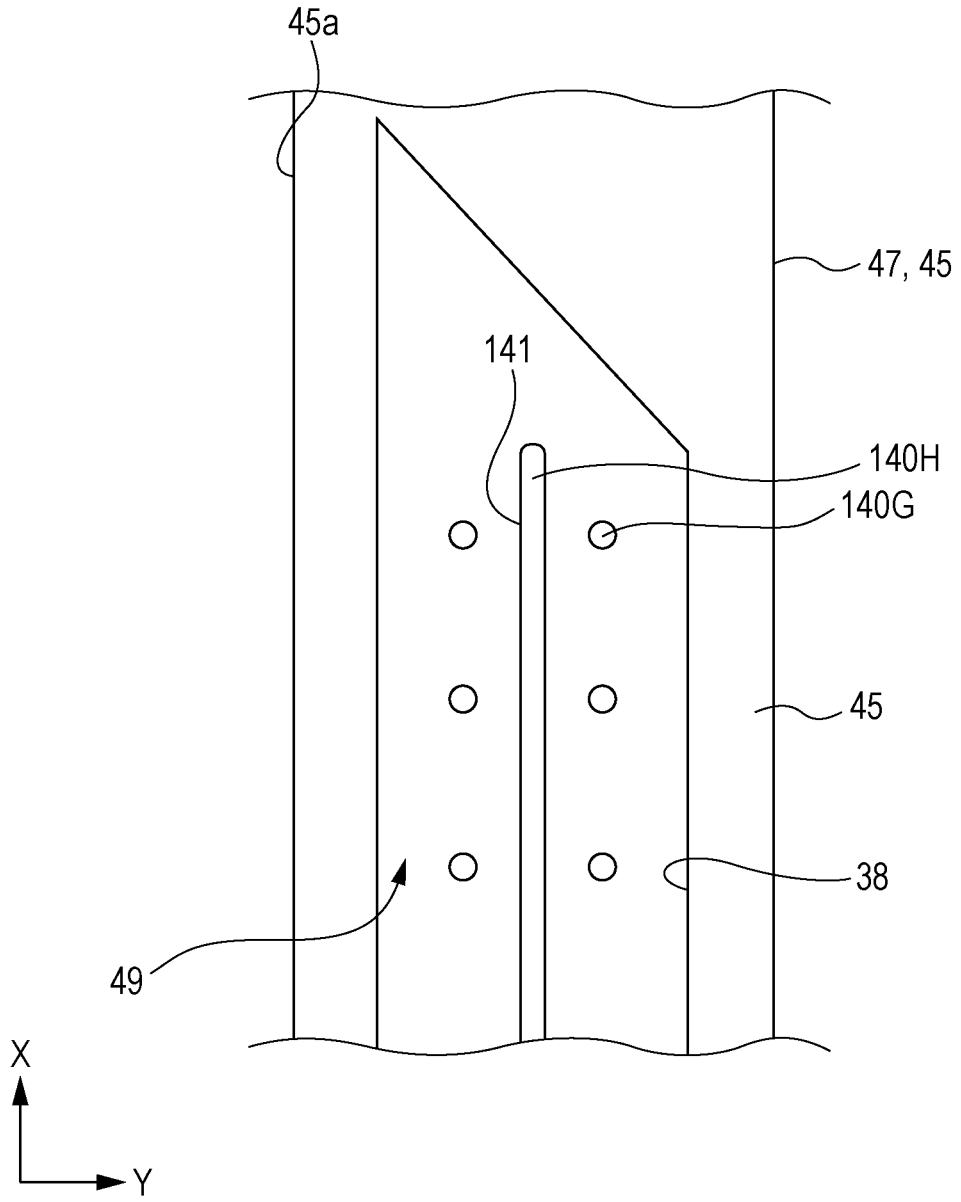
FIG. 19 is an enlarged plan view of a principal portion of a compliance portion according to Embodiment 9.

FIG. 19 is a plan view of a compliance substrate according to Embodiment 9 of the invention. The same reference numerals and letters are given to the same members as those in Embodiments 1 to 8, and the same descriptions as those in Embodiments 1 to 8 will not be repeated.

Protrusion portions 140H and 140G which regulate adhering of the compliance portion 49 to the cover head 130 are provided in the space 131 formed in a portion between the compliance portion 49 of Embodiment 9 and the cover head 130, as illustrated in FIG. 19.

The protrusion portion 140H is provided in a substantially central portion of the space 131 in the second direction Y so as to continuously extend in the second direction Y.

The protrusion portion 140G has a cylindrical shape. A plurality of the protrusion portions 140G are provided at both sides of the protrusion portion 140H in the second direction Y so as to be aligned in the first direction X at predetermined intervals.

In Embodiment 9, the protrusion portion 140H is provided in the compliance substrate 45. Thus, in a center portion of the space 131 in the second direction Y, the compliance portion 49 can be prevented from adhering to the cover head 130. Furthermore, the protrusion portion 140G is provided in the compliance substrate 45. Thus, in a portion between the opening edge portion of the opening portion 38 and the protrusion portion 140H, the compliance portion 49 can be prevented from adhering to the cover head 130. In addition, the plurality of protrusion portions 140G having a cylindrical shape are provided in the compliance substrate 45, and thus an area regulating the compliance portion 49 is reduced, compared to the case of the protrusion portion 140H. As a result, it is possible to prevent deterioration of a compliance function of the compliance portion 49.

Embodiment 10

Figure 20:
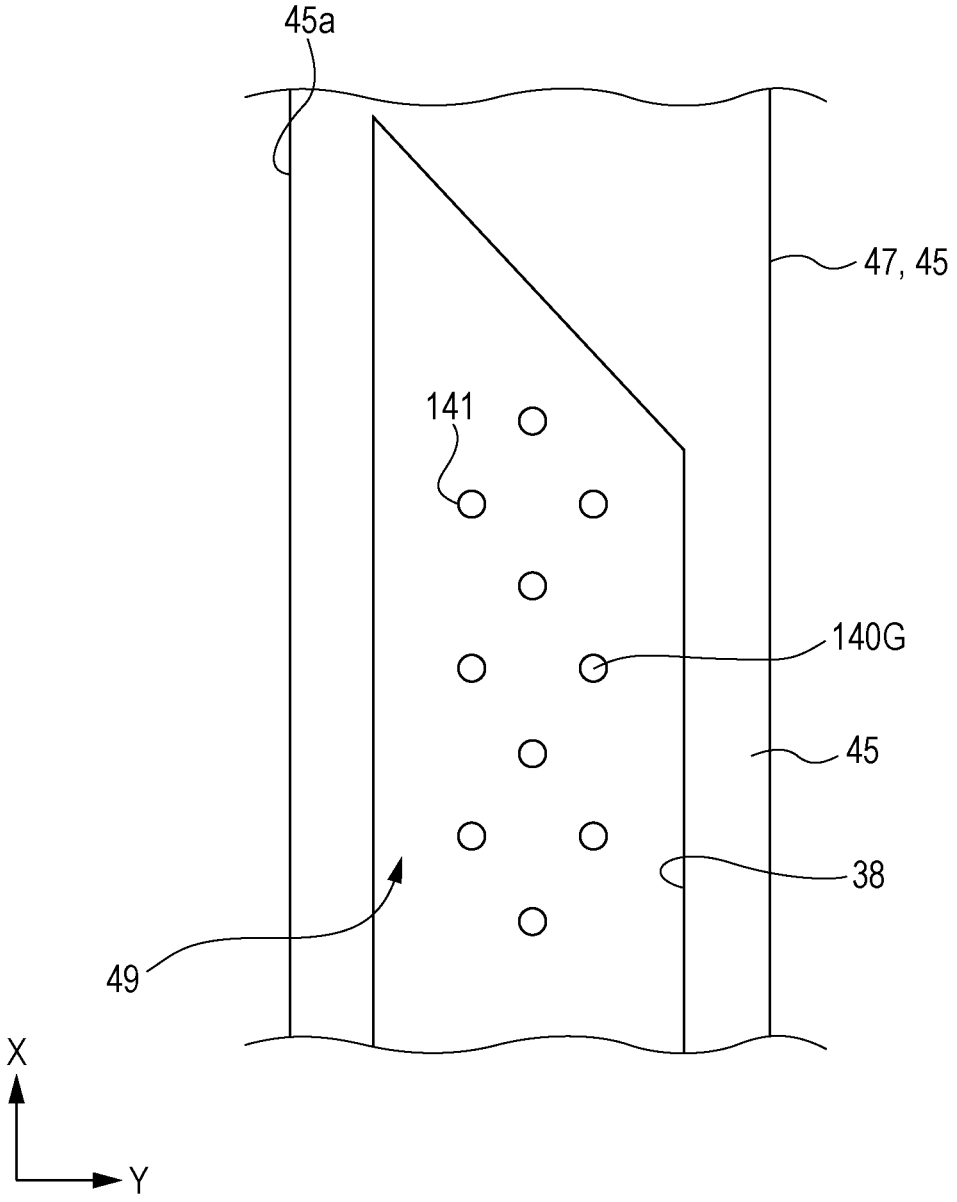
FIG. 20 is an enlarged plan view of a principal portion of a compliance portion according to Embodiment 10.

FIG. 20 is a plan view of a compliance substrate according to Embodiment 10 of the invention. The same reference numerals and letters are given to the same members as those in Embodiments 1 to 9, and the same descriptions as those in Embodiments 1 to 9 will not be repeated.

A plurality of the protrusion portion 140G which regulate adhering of the compliance portion 49 to the cover head 130 are provided in the space 131 formed in a portion between the compliance portion 49 of Embodiment 10 and the cover head 130, as illustrated in FIG. 20.

The protrusion portions 140G are provided such that a pair of the protrusion portions 140G aligned in the second direction Y and one protrusion portion 140G are alternately arranged in the first direction X. The pair of protrusion portions 140G aligned in the second direction Y are arranged in a state where gaps between the protrusion portions 140G and the opening edge portion of the opening portion 38 and a gap between the protrusion portions 140G are divided into three equal intervals, in the second direction Y. In this case, the one protrusion portion 140G is disposed in a center portion of the space 131 in the second direction Y.

In this configuration, the plurality of protrusion portions 140G can reduce an area regulating the compliance portion 49, compared to cases in which the protrusion portions 140F and 140H of above-described Embodiments 7 to 9 are provided in the compliance substrate 45. Thus, it is possible to further prevent the protrusion portion 140G from deteriorating a compliance function of the compliance portion 49.

Other Embodiments

Hereinbefore, each embodiment of the invention is described. However, a basic configuration of the invention is not limited to those described above.

In the above-described Embodiments 1 to 10, for example, a configuration in which two manifolds 100 are provided in the head main body 11 and the compliance portion 49 is provided for each manifold 100 is exemplified. However, the configuration is not limited thereto. Here, other examples of a manifold are illustrated in FIGS. 21A to 22B. FIGS. 21A to 22B are plan views of communication plates as a modification example of a manifold and a compliance portion and plan views of compliance substrates.

Figure 21B:
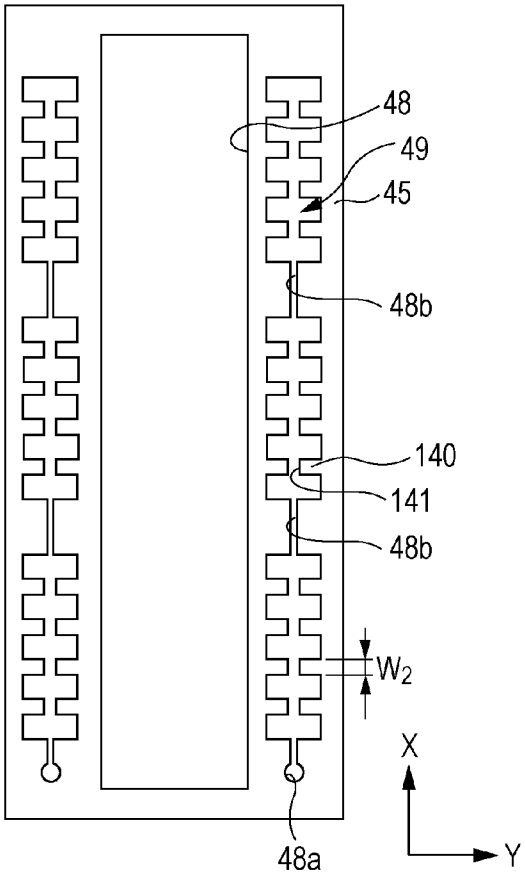
FIGS. 21A and 21B are plan views of a communication plate and a compliance substrate according to another Embodiment.
Figure 21A:
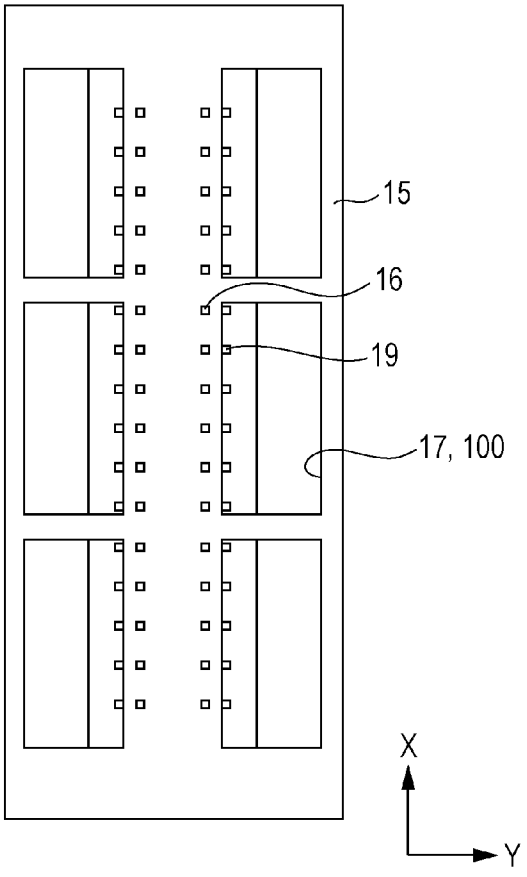

Two rows, each of which is constituted by three manifolds 100 aligned in the first direction X, are aligned in the second direction Y, as illustrated in FIG. 21A. In other words, in total, six manifolds 100 are provided in the head main body 11. Incidentally, when the manifolds 100 are separately provided in the first direction X, it is possible to supply different ink (liquid) to each manifold 100. Therefore, it is possible to discharge different inks through the nozzle openings 21 which communicate with, for example, three manifolds 100 aligned in the first direction X.

The compliance portion 49 is provided for each manifold 100, as illustrated in FIG. 21B. In other words, in an example illustrated in FIGS. 21A and 21B, six compliance portions 49 are provided to correspond to six manifolds 100.

The through hole 48*a* is provided to the compliance portion 49 on one end portion in the first direction X. Adjacent spaces 131 in the first direction X, which are formed in a portion between the compliance portion 49 and the cover head 130, communicate through a communication path 48*b* for atmosphere releasing. An opening of the communication path 48*b* for atmosphere releasing has a size in which a flow path resistance of gas flowing in the spaces 131 corresponding to the respective compliance portions 49 is not great. The communication path 48*b* for atmosphere releasing is provided, and thus the spaces 131 which are formed in a portion between three manifolds 100 aligned in the first direction X and the cover head 130 communicate with each other. Therefore, the spaces 131 are opened to the atmosphere through one through hole 48*a*. In addition, in this embodiment, the width $W_2$ of the protrusion portion 140 itself in the first direction is shorter than a length of the communication path 48*b* for atmosphere releasing in the first direction X. Furthermore, in this embodiment, the space 131 which communicates with one through hole 48*a* is referred to as a first space, and the space 131 which communicates with the first space through the communication path 48*b* for atmosphere releasing is referred to as a second space. In other words, in the example illustrated in FIGS. 21A and 21B, two second spaces are provided for each first space.

One first space which communicates with an atmosphere releasing path (not illustrated except for the through hole 48*a*) that is opened to the atmosphere and two second spaces which communicate with the first space are provided as described above. Thus, upon comparison with a case in which the atmosphere releasing path is provided for each space, it is possible to reduce the size of the head because a space for installing a plurality of atmosphere releasing paths is not necessary. Furthermore, the width $W_2$ of the protrusion portion 140 itself in the first direction X is shorter than the length of the communication path 48*b* for atmosphere releasing in the first direction X. Thus, upon comparison with a case where the width $W_2$ is not shorter than the length of the communication path 48*b* for atmosphere releasing, it is possible to prevent an individual compliance amount from being reduced by the protrusion portion 140. Furthermore, in a portion between the manifolds 100 aligned in the first direction X, it is possible to ensure an adhesion area between the communication plate 15 and the compliance substrate 45. As a result, it is possible to improve adhesive properties.

Figure 22B:
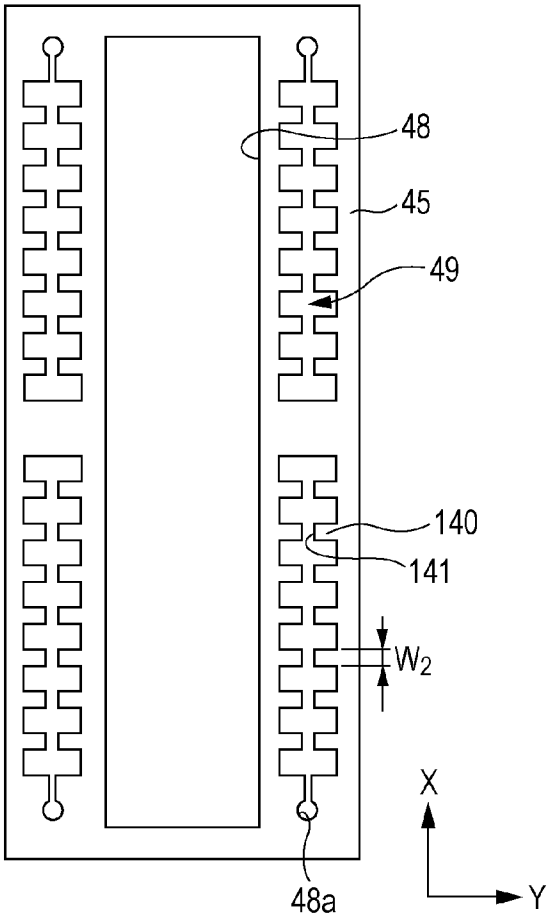
FIGS. 22A and 22B are plan views of a communication plate and a compliance substrate according to another Embodiment.
Figure 22A:
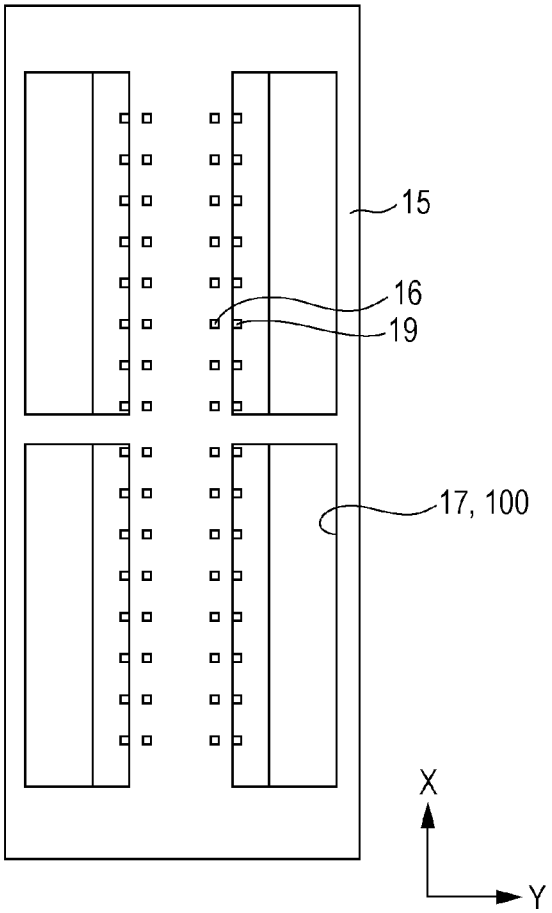

Two rows, each of which is constituted by two manifolds 100 aligned in the first direction X, are provided in the second direction Y, as illustrated in FIG. 22A. In other words, in total, four manifolds 100 are provided.

The compliance portion 49 is provided for each manifold 100, as illustrated in FIG. 22B. In other words, in an example illustrated in FIGS. 22A and 22B, four compliance portions 49 are provided to correspond to four manifolds 100.

The spaces 131 formed in a portion between the compliance portion 49 and the cover head 130 are partitioned so as not to communicate with each other.

In addition, the through holes 48*a* are provided on both sides of the compliance portions 49 (the opening portions 48) aligned in the first direction X of the fixing substrate 47. Each space 131 formed in a portion between each compliance portion 49 and the cover head 130 is opened to the atmosphere through the through hole 48*a*. In other words, in the example illustrated in FIGS. 22A and 22B, spaces 131 formed in portions between the compliance portions 49 and the cover head 130 are opened to the atmosphere in a state where the spaces 131 do not communicate with each other. In this embodiment, the width $W_2$ of the protrusion portion 140 itself in the first direction X is shorter than the interval between the compliance portions 49 aligned in the first direction X. Therefore, it is possible to prevent the individual compliance amount from being reduced by the protrusion portion 140. Furthermore, in a portion between the manifolds 100 aligned in the first direction X, it is possible to ensure an adhesion area between the communication plate 15 and the compliance substrate 45. As a result, it is possible to improve adhesive properties.

The protrusion portions 140 to 140E are provided as described in Embodiments 1 to 10, and thus it is possible to prevent the compliance portion 49 from adhering to the cover head 130 even in the configurations illustrated in FIGS. 21A to 22B.

In Embodiments described above, the protrusion portions 140 to 140E are provided in the compliance substrate 45 (the fixing substrate 47). However, the configuration is not limited thereto. The protrusion portions 140 to 140E may be provided on, for example, the cover head 130 (as a cap member) side. Needless to say, the protrusion portions 140 to 140E may be provided in a member other than the compliance substrate 45 and the cover head 130 (the cap member).

In Embodiments described above, the compliance substrate 45 is provided on the surface side on which the nozzle plate 20 is provided. However, the configuration is not limited thereto. The compliance substrate 45 may be provided on, for example, the case member 40 side or a lateral surface intersecting the liquid ejection surface 20*a*. In other words, any member can be used as a cap member as long as the space 131 can be formed in a portion between the member and the compliance portion 49 of the compliance substrate 45. Thus, the cap member is not limited to the cover head 130 and may be a member other than the cover head 130.

In Embodiments described above, the piezoelectric actuator 300 of a thin-film type is used as a pressure generation unit which causes a pressure change in the pressure generation chamber 12. However, without being limited thereto, a thick-film type piezoelectric actuator which is formed by attaching a green sheet, a longitudinal vibration type piezoelectric actuator in which piezoelectric material and electrode-forming material are alternately stacked on each other and the stacked material expands and contracts in an axial direction, or the like can be used as the pressure generation unit. In addition, a device in which a heater element is disposed in the pressure generation chamber and liquid droplets are discharged through the nozzle openings, using bubbles generated by heating of the heater element, a so-called electrostatic actuator in which liquid droplets are discharged through nozzle openings in such a manner that static electricity is generated between a diaphragm and an electrode and the diaphragm is deformed by the static electricity, or the like can be used as the pressure generation unit.

Figure 23:
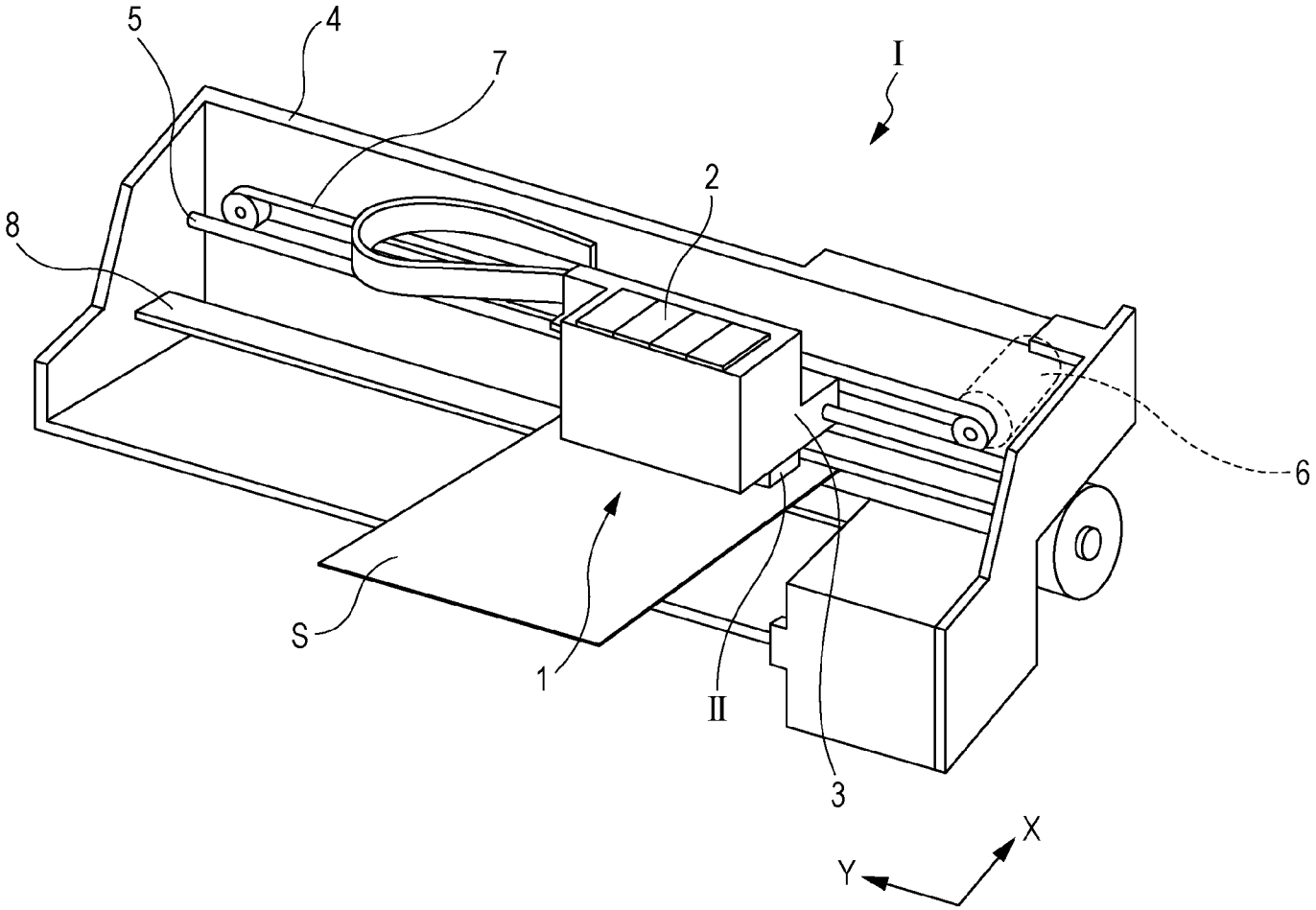
FIG. 23 is a schematic view of a recording apparatus according to Embodiment of the invention.

The ink jet type recording head II of Embodiments described above constitutes a part of the ink jet type recording head unit having an ink flow path communicating with an ink cartridge or the like. The ink jet type recording head II is mounted on an ink jet type recording apparatus. FIG. 23 is a schematic view of an example of the ink jet type recording apparatus.

In an ink jet type recording apparatus I illustrated in FIG. 23, cartridges 2A and 2B constituting an ink supply unit are attachably/detachably mounted on the ink jet type recording head unit 1 (hereinafter, referred to as a head unit 1) having a plurality of ink jet type recording heads II. In addition, a carriage 3 on which the head unit 1 is mounted is installed on a carriage shaft 5 attached to an apparatus main body 4, in a state where the carriage 3 can move in a shaft direction. The recording head unit 1 discharges, for example, black ink composition and color ink composition, respectively.

A driving force of a driving motor 6 is transmitted to the carriage 3 through a plurality of gears (not illustrated) and a timing belt 7, and thus the carriage 3 on which recording head units 1A and 1B are mounted moves along the carriage shaft 5. Meanwhile, a transport roller 8 as a transport unit is installed in the apparatus main body 4 and a recording sheet S as a recording medium, such as a paper sheet, is transported by the transport roller 8. The transport unit which transports the recording sheet S is not limited to the transport roller 8 and may be a belt, a drum, or the like.

In the description of the ink jet type recording apparatus I, a configuration in which the ink jet type recording head II (the head unit 1) is mounted to the carriage 3 and moves in a main scanning direction is exemplified. However, the configuration is not limited thereto. The invention can be applied to a so-called line type recording apparatus in which the ink jet type recording head II is fixed and printing is performed by moving only the recording sheet S, such as a paper sheet, in a sub-scanning direction.

In an example described above, the ink jet type recording apparatus I has a configuration in which an ink cartridge 2 as a liquid storage unit is mounted to the carriage 3. However, the configuration is not limited thereto. For example, a liquid storage unit, such as an ink tank, may be fixed to the apparatus main body 4 and the storage unit and the ink jet type recording head II may be connected through a supply tube, such as a tube. A liquid storage unit may not be mounted on the ink jet type recording apparatus.

The invention is intended to be widely applied to general liquid ejecting heads and can be applied to, for example, a recording head, such as various types of an ink jet type recording head used for an image recording apparatus, such as a printer, a coloring material ejecting head used to manufacture a color filter for a liquid crystal display or the like, an electrode material ejecting head used to form an electrode for an organic EL display, a field emission display (FED) or the like, and a bio-organic material ejecting head used to manufacture a biochip.

What is claimed is:

1. A liquid ejecting head, comprising:

a manifold which communicates with a plurality of nozzle openings through which liquid is ejected;

a compliance portion which constitutes a part of the manifold and is constituted by a film having flexibility;

a fixing plate which is fixed to a surface side of the film, which is a side opposite to the manifold, and has an opening formed in the compliance portion; and a cap member which is fixed to a surface side of the fixing plate, which is a side opposite to the compliance portion, and covers the opening, wherein a protrusion portion which regulates adhering of the film to the cap member is provided, in a state where the protrusion portion is not fixed to the fixing plate, in a space formed in a portion between the compliance portion and the cap member, wherein the protrusion portion is fixed to one of the film and the cap member, and is not fixed to the other, wherein the protrusion portion and the other of the film and the cap member are configured to separate following deformation of the film.

2. The liquid ejecting head according to claim 1, wherein the protrusion portion is fixed to the film and is not fixed to the cap member.

3. The liquid ejecting head according to claim 1, wherein a plurality of the protrusion portions are arranged in an alignment direction of the nozzle openings, and wherein the plurality of the protrusion portions have protrusion portions of at least two types in which sizes of the protrusion portions in a direction perpendicular to the alignment direction of the nozzle openings are different in an in-plane direction of the film.

4. The liquid ejecting head according to claim 1, wherein a plurality of the manifolds are provided, and wherein each space which is formed in a portion between the compliance portion corresponding to each manifold and the cap member is separately opened to the atmosphere.

5. The liquid ejecting head according to claim 1, wherein a plurality of the manifolds are provided, and wherein the space which is formed in a portion between the compliance portion corresponding to the manifold and the cap member has a first space which is opened to the atmosphere and a second space which communicates with the first space and is opened to the atmosphere through the first space.

6. The liquid ejecting head according to claim 1, wherein the protrusion portion is formed of the same material as the fixing plate.

7. The liquid ejecting head according to claim 6, wherein the protrusion portion is formed by performing etching on the fixing plate which is adhered to the film.

8. A liquid ejecting apparatus comprising:

the liquid ejecting head according to claim 1.

9. A liquid ejecting apparatus comprising:

the liquid ejecting head according to claim 2.

10. A liquid ejecting apparatus comprising:

the liquid ejecting head according to claim 6.

* * * * *